US008948620B2

(12) United States Patent
Imazeki et al.

(10) Patent No.: US 8,948,620 B2
(45) Date of Patent: Feb. 3, 2015

(54) IMAGE FORMING SYSTEM AND LATENT IMAGE CARRIER REPLACEMENT TIME DETECTION METHOD

(71) Applicants: Mikiko Imazeki, Kanagawa (JP); Yasushi Nakazato, Tokyo (JP); Akira Takehisa, Tokyo (JP)

(72) Inventors: Mikiko Imazeki, Kanagawa (JP); Yasushi Nakazato, Tokyo (JP); Akira Takehisa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 65 days.

(21) Appl. No.: 13/766,926

(22) Filed: Feb. 14, 2013

(65) Prior Publication Data

US 2013/0251383 A1 Sep. 26, 2013

(30) Foreign Application Priority Data

Mar. 21, 2012 (JP) ..... 2012-063624

(51) Int. Cl.
*G03G 15/00* (2006.01)
*G03G 21/00* (2006.01)

(52) U.S. Cl.
CPC ..... *G03G 15/553* (2013.01); *G03G 15/5037* (2013.01); *G03G 15/75* (2013.01); *G03G 21/0094* (2013.01)
USPC ..... 399/26

(58) Field of Classification Search
CPC ..... G03G 2221/1663
USPC ..... 399/26
See application file for complete search history.

(56) References Cited

U.S. PATENT DOCUMENTS

| | | | | |
|---|---|---|---|---|
| 5,835,818 | A * | 11/1998 | Hoshika et al. | 399/26 |
| 6,549,733 | B2 * | 4/2003 | Matsuguma | 399/26 |
| 7,433,611 | B2 * | 10/2008 | Nagamochi et al. | 399/26 |
| 7,831,157 | B2 * | 11/2010 | Yamaguchi et al. | 399/26 |
| 2011/0170884 | A1 | 7/2011 | Yamane et al. | |
| 2011/0246107 | A1 * | 10/2011 | Burry et al. | 702/64 |
| 2012/0065885 | A1 | 3/2012 | Imazeki et al. | |
| 2012/0075659 | A1 | 3/2012 | Sawada et al. | |

FOREIGN PATENT DOCUMENTS

| | | |
|---|---|---|
| JP | 64-081080 | 3/1989 |
| JP | 3-243978 | 10/1991 |
| JP | 3-294872 | 12/1991 |
| JP | 06-289717 | 10/1994 |
| JP | 2621879 | 4/1997 |
| JP | 2006-011230 | 1/2006 |

* cited by examiner

*Primary Examiner* — Sandra Brase
(74) *Attorney, Agent, or Firm* — Harness, Dickey & Pierce, P.L.C.

(57) ABSTRACT

An image forming system includes an image forming apparatus, a physical property detector, a data storage device, and a latent image carrier replacement time detector. The image forming apparatus includes a replaceable latent image carrier, forms a latent image on a surface of the latent image carrier, develops the latent image into a visible image, and transfers the visible image onto a recording medium. The physical property detector detects predetermined physical properties of the image forming apparatus in a continuous manner or an intermittent manner. The data storage device stores, as a specific physical property, data on at least one of the detected physical properties, which changes before and after replacement of the latent image carrier. The latent image carrier replacement time detector detects, on the basis of changes over time of the stored specific physical property, a latent image carrier replacement time.

7 Claims, 10 Drawing Sheets

IMAGE FORMING SYSTEM AND LATENT IMAGE CARRIER REPLACEMENT TIME DETECTION METHOD

CROSS-REFERENCE TO RELATED APPLICATION

This patent application is based on and claims priority pursuant to 35 U.S.C. §119 to Japanese Patent Application No. 2012-063624, filed on Mar. 21, 2012, in the Japan Patent Office, the entire disclosure of which is hereby incorporated by reference herein.

BACKGROUND OF THE INVENTION

1. Field of the Invention

The present invention relates to an image forming system and a latent image carrier replacement time detection method which detect information of a latent image carrier replacement time useful in maintenance and analysis of an image forming apparatus including a latent image carrier, such as a photoconductor.

2. Description of the Related Art

An electrophotographic image forming apparatus forms an image by, for example, causing a charging device to uniformly charge a surface of a photoconductor serving as a latent image carrier to a predetermined potential, causing an exposure device to expose the charged surface of the photoconductor with light to form an electrostatic latent image, causing a development device to develop the electrostatic latent image on the surface of the photoconductor with toner to form a toner image, and transferring the toner image onto a recording medium. The photoconductor is replaced with a new photoconductor periodically or in the event of an unexpected failure, for example. Information concerning a photoconductor replacement time at which the photoconductor is replaced with a new photoconductor is useful in predicting the time of the next periodical replacement of the photoconductor.

Further, physical properties of the photoconductor and other components immediately before the replacement of the photoconductor may be used to detect the respective states of the photoconductor and the components at the time of failure or degradation, and are useful in, for example, analysis for failure prediction and design of a next-generation model. To obtain such physical properties, it is necessary to know the photoconductor replacement time, and in this regard also the photoconductor replacement time is useful information. Herein, the physical properties of the photoconductor include photoconductor potential, such as the potential of a latent image portion on the surface of the photoconductor (i.e., post-exposure potential), the potential of a non-latent image portion on the surface (i.e., uniform charge potential), and residual potential (i.e., post-discharge photoconductor surface potential).

The photoconductor replacement time may be detected from a maintenance date and time and a total count recorded in a maintenance work report in photoconductor replacement. Such information, however, is manually recorded, and thus an input error or an input omission may occur in the recording. It is therefore difficult to highly accurately detect the photoconductor replacement time.

The image forming apparatus may be controlled by a method which registers, in a storage medium, replacement history information including identification information of a replacement target component, such as a photoconductor, input to the image forming apparatus, and which, upon replacement of the replacement target component, adds the identification information of the replacement target component newly input to the replacement history information stored in the storage medium. The replacement history information includes the date of actual replacement of the component. The method, therefore, is capable of detecting the photoconductor replacement time with reference to the replacement history information.

According to this method, however, the replacement history information is manually input, and thus an input error or an input omission may occur similarly as in the foregoing method of recording the maintenance work report. It is therefore difficult to highly accurately detect the photoconductor replacement time.

Alternatively, the image forming apparatus may be provided with a sensor for detecting the installation of a photoconductor in the image forming apparatus, and may determine, upon detection of the installation of a photoconductor, that photoconductor replacement has taken place, and record the photoconductor replacement history information.

According to this method, the photoconductor replacement history information is recorded on the basis of the detection result of the sensor which detects the installation of a photoconductor. The method does not involve manual work, and thus is capable of detecting the photoconductor replacement time by ruling out human error. According to the method, however, if the photoconductor is removed from the image forming apparatus and reinstalled therein immediately thereafter, for example, it is determined that photoconductor replacement has taken place, with no distinction made between reinstallation of the non-new photoconductor and installation of a new photoconductor. It is therefore difficult to highly accurately detect the photoconductor replacement time at which the non-new photoconductor is replaced with a new photoconductor.

Accordingly, a new expendable item (e.g., photoconductor) may be provided with an identification chip indicating that the item is new, and the image forming apparatus installed with the new expendable item may detect the replacement of the expendable item with the use of the identification chip, and store the replacement time of the expendable item on the basis of the detection result. In this case, the image forming apparatus includes a device that removes the new item identification chip after the replacement of the expendable item is detected. If a non-new expendable item is installed in the image forming apparatus, therefore, the expendable item is not erroneously identified as a new expendable item, and the photoconductor replacement time is highly accurately detected.

According to this method, the photoconductor replacement is detected with the use of the new item identification chip provided to the photoconductor. The method is therefore capable of detecting the replacement time of a new photoconductor by ruling out human error and distinguishing the replacement of a new photoconductor from the reinstallation of a non-new photoconductor. Accordingly, the photoconductor replacement time at which a non-new photoconductor is replaced with a new photoconductor is highly accurately detected.

According to the method, however, a new item identification chip is provided to the photoconductor, and the device for removing the identification chip after the installation of a new photoconductor into the image forming apparatus is provided to the image forming apparatus. The method, therefore, increases component cost and manufacturing cost.

SUMMARY OF THE INVENTION

The present invention describes a novel image forming system that, in one example, includes an image forming apparatus, a physical property detector, a data storage device, and a latent image carrier replacement time detector. The image forming apparatus includes a replaceable latent image carrier, and is configured to form a latent image on a surface of the latent image carrier, develop the latent image into a visible image, and transfer the visible image onto a recording medium. The physical property detector is configured to detect predetermined physical properties of the image forming apparatus in one of a continuous manner and an intermittent manner. The data storage device is configured to store, as a specific physical property, data on at least one of the physical properties detected by the physical property detector, which changes before and after replacement of the latent image carrier. The latent image carrier replacement time detector is configured to detect, on the basis of changes over time of the specific physical property stored in the data storage device, a latent image carrier replacement time.

The image forming apparatus may further include a charging device configured to uniformly charge the surface of the latent image carrier to a predetermined charge potential, and a discharging device configured to discharge the surface of the latent image carrier after the transfer of the visible image developed from the latent image formed on the surface of the latent image carrier uniformly charged and exposed to light. The specific physical property may include a potential of the surface of the latent image carrier discharged by the discharging device.

The latent image carrier replacement time detector may calculate an approximate equation which approximates values of the specific physical property detected in a predetermined approximation period to a predetermined functional equation, and may detect the latent image carrier replacement time on the basis of an approximate value obtained from the approximate equation.

The latent image carrier replacement time detector may calculate, on the basis of successive first and second approximation periods, a difference between an approximate value corresponding to an end of the first approximation period obtained by the approximate equation approximating values of the specific physical property detected in the first approximation period and an approximate value corresponding to a beginning of the second approximation period obtained by the approximate equation approximating values of the specific physical property detected in the second approximation period. When the difference is at least a specified value, the latent image carrier replacement time detector may detect, as the latent image carrier replacement time, a time corresponding to a boundary between the first and second approximation periods.

The latent image carrier replacement time detector may sequentially calculate the difference while shifting the first and second approximation periods, and may detect, as the latent image carrier replacement time, a time corresponding to a boundary between the first and second approximation periods, at which the difference is maximized in a predetermined period.

The image forming system may further include a cumulative usage information storage device configured to store data on a cumulative usage of the latent image carrier, a cumulative usage resetting device configured to reset the data on the cumulative usage stored in the cumulative usage information storage device, and a reset time storage device configured to store data on a reset time at which the cumulative usage resetting device resets the data on the cumulative usage. The latent image carrier replacement time detector may detect the latent image carrier replacement time by using the data on the reset time stored in the reset time storage device.

When the reset time corresponding to the data stored in the reset time storage device does not match the latent image carrier replacement time detected on the basis of the changes over time of the specific physical property stored in the data storage device, the latent image carrier replacement time detector may not detect the reset time as the latent image carrier replacement time.

The latent image carrier replacement time detector may not detect the latent image replacement time before a predetermined period of time elapses after the last detected latent image carrier replacement time.

The present invention further describes a novel latent image carrier replacement time detection method of detecting a latent image carrier replacement time of a latent image carrier in an image forming apparatus which forms a latent image on a surface of the latent image carrier, develops the latent image into a visible image, and transfers the visible image onto a recording medium. In one example, the novel latent image carrier replacement time detection method includes detecting predetermined physical properties of the image forming apparatus in one of a continuous manner and an intermittent manner; storing, as a specific physical property, data on at least one of the detected physical properties, which changes before and after replacement of the latent image carrier; and detecting, on the basis of changes over time of the stored specific physical property, the latent image carrier replacement time.

BRIEF DESCRIPTION OF THE SEVERAL VIEWS OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION OF THE INVENTION

Figure 1:
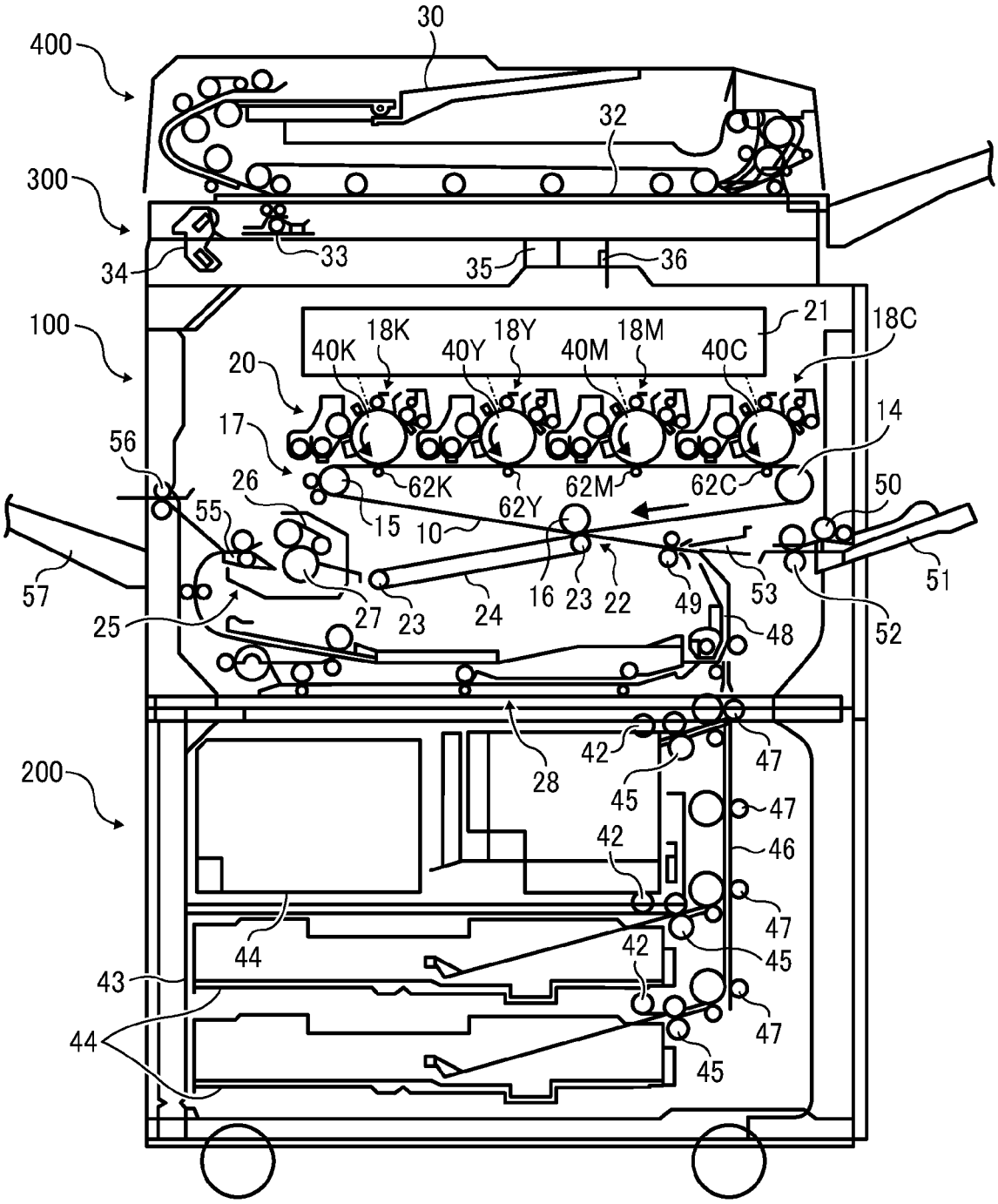
FIG. 1 is a schematic configuration diagram illustrating an example of a copier maintained by an image forming system according to an embodiment of the present invention serving as a maintenance support system.

In describing the embodiments illustrated in the drawings, specific terminology is adopted for the purpose of clarity. However, the disclosure of the present invention is not intended to be limited to the specific terminology so used, and it is to be understood that substitutions for each specific element can include any technical equivalents that have the same function, operate in a similar manner, and achieve a similar result.

Referring now to the drawings, wherein like reference numerals designate identical or corresponding parts throughout the several views, description will be given of an image forming system according to an embodiment of the present invention, which includes an electrophotographic copier (hereinafter simply referred to as the copier) serving as an image forming apparatus.

FIG. 1 is a schematic configuration diagram illustrating an example of the copier maintained by the image forming system according to the present embodiment serving as a maintenance support system. The copier includes a printer unit 100, a sheet feeding unit 200, a scanner unit 300, and a document feeding unit 400. The printer unit 100 and the sheet feeding unit 200 form an image forming unit. The scanner unit 300 is installed on the printer unit 100, and the document feeding unit 400 is installed on the scanner unit 300. The scanner unit 300 includes a contact glass 32, a first carriage 33, a second carriage 34, an imaging lens 35, and a reading sensor 36. The document feeding unit 400 includes an automatic document feeder (ADF) including a document table 30.

The sheet feeding unit 200 includes an automatic sheet feeding unit provided under the printer unit 100, and a manual sheet feeding unit provided to a side surface of the printer unit 100. In the automatic sheet feeding unit including a sheet bank 43 including multiple sheet feeding cassettes 44, sheet feed rollers 42, separation roller pairs 45, and feed rollers 47, a transfer sheet serving as a recording medium is fed from one of the sheet feeding cassettes 44 by the corresponding sheet feed roller 42, separated from other transfer sheets and fed to a sheet feed path 46 by the corresponding separation roller pair 45, and fed to a sheet feed path 48 of the printer unit 100 by the corresponding feed roller 47. Meanwhile, in the manual sheet feeding unit including a sheet feed roller 50, a manual sheet feeding tray 51, and a separation roller pair 52, a transfer sheet is fed from the manual sheet feeding tray 51 by the sheet feed roller 50, and separated from other transfer sheets and fed to a manual sheet feed path 53 by the separation roller pair 52.

The printer unit 100 includes an exposure device 21, a tandem unit 20 including four process units 18K, 18Y, 18M, and 18C respectively including four photoconductors 40K, 40Y, 40M, and 40C, primary transfer rollers 62K, 62Y, 62M, and 62C, a belt unit including an intermediate transfer belt 10 and support rollers 14, 15, and 16, a belt cleaning device 17, a secondary transfer device 22 including two support rollers 23 and a secondary transfer belt 24, a fixing device 25 including a heating belt 26 and a pressure roller 27, a switching member 55, a transfer sheet reversing device 28, a sheet feed path 48, a registration roller pair 49, a discharge roller pair 56, and a sheet discharging tray 57. The printer unit 100 further includes a sheet discharging device and a toner supply device, which are not illustrated. Herein, the suffixes K, Y, M, and C following reference numerals indicate that components designated thereby correspond to black, yellow, magenta, and cyan colors, respectively.

In the printer unit 100, the registration roller pair 49 is disposed near an end of the sheet feed path 48 to receive the transfer sheet fed from one of the sheet feeding cassettes 44 and the manual sheet feeding tray 51, and feed the transfer sheet with predetermined timing to a secondary transfer nip formed between the secondary transfer device 22 and the intermediate transfer belt 10 serving as an intermediate transfer member.

Figure 3:
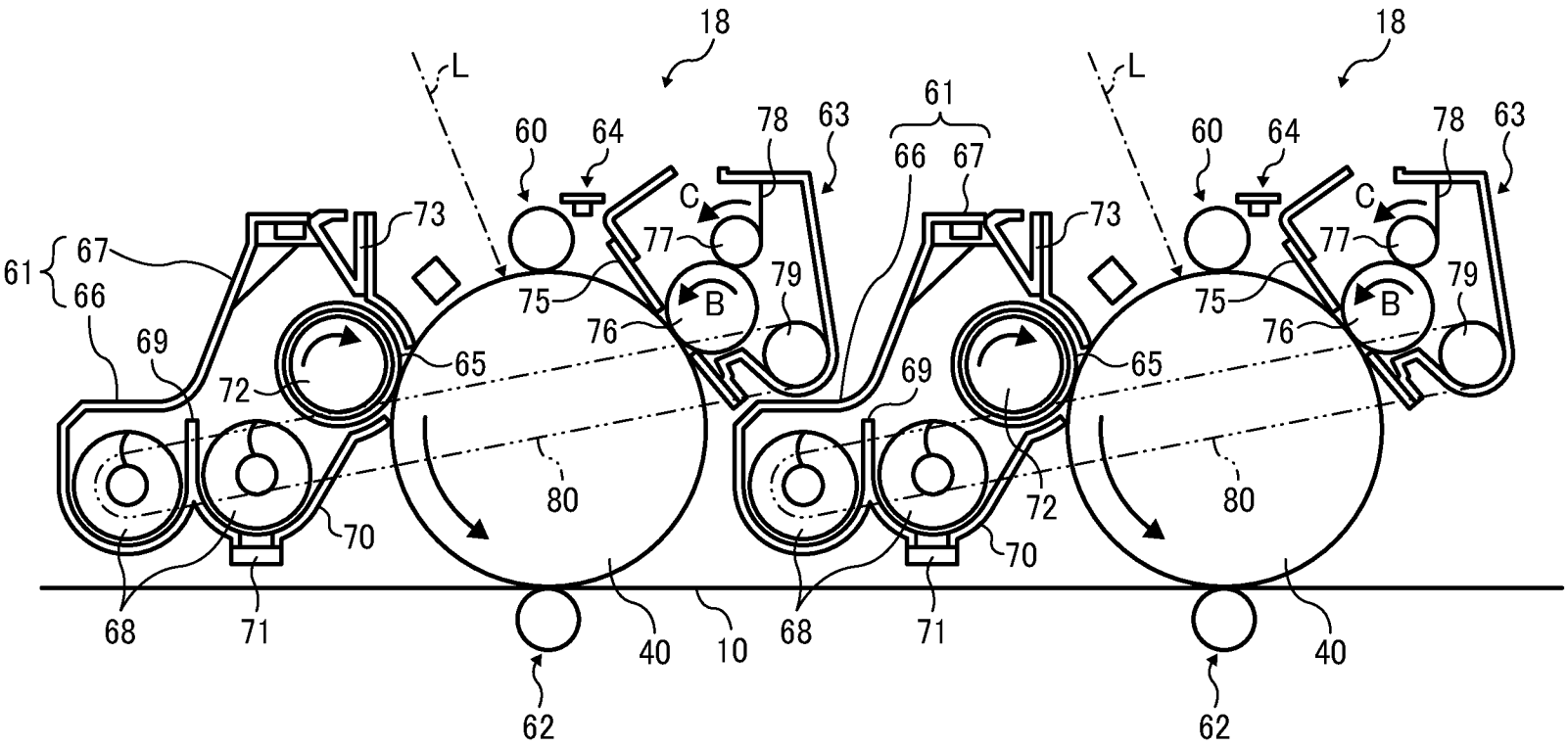
FIG. 3 is a partial enlarged view illustrating a part of a tandem unit of the printer unit.
Figure 4:
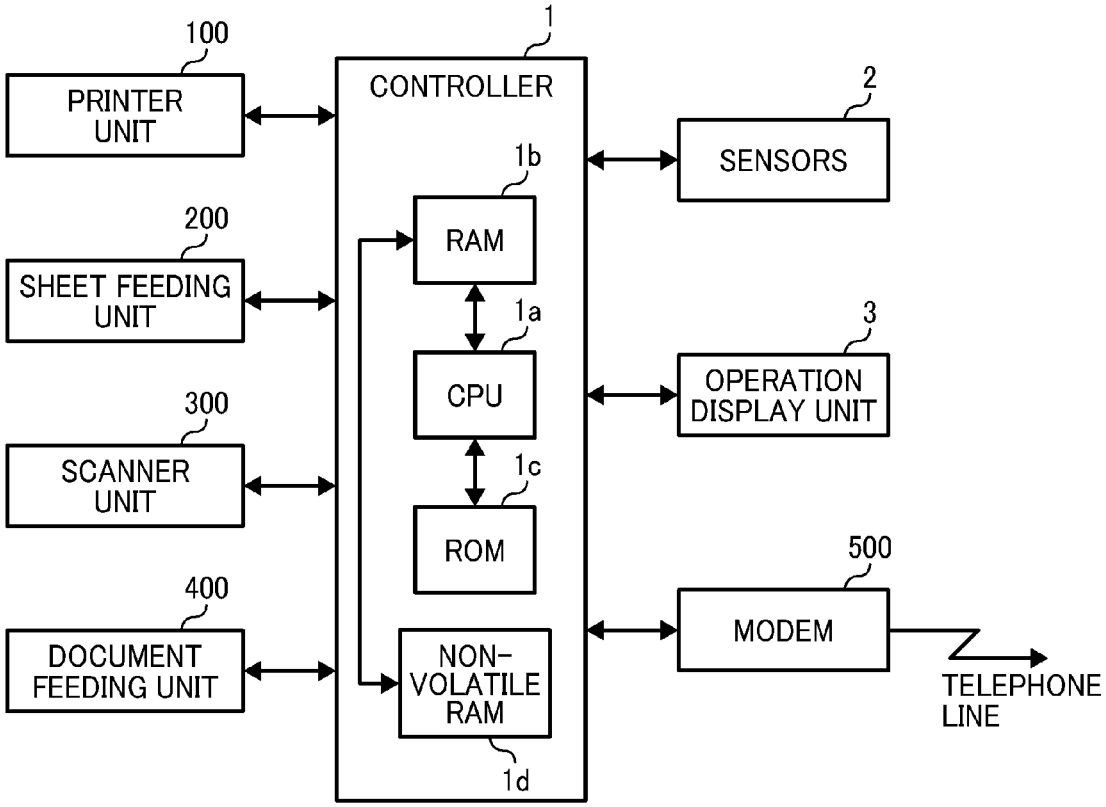
FIG. 4 is a block diagram illustrating a control system of the copier.

In the scanner unit 300, image information of a document placed on the contact glass 32 is read by the reading sensor 36, and is transmitted to a controller 1 (see FIG. 4). On the basis of the image information received from the scanner unit 300, the controller 1 controls components provided in the exposure device 21 of the printer unit 100, such as lasers and light-emitting diodes (LEDs), to emit beams of laser light L illustrated in FIG. 3 to the four drum-shaped photoconductors 40K, 40Y, 40M, and 40C serving as latent image carriers. Respective outer circumferential surfaces of the photoconductors 40K, 40Y, 40M, and 40C are irradiated with the beams of laser light L to form thereon electrostatic latent images. The latent images are developed through a predetermined development process to form visible toner images.

To make a copy of a color image, an operator places a document on the document table 30 of the document feeding unit 400. Alternatively, the operator opens the document feeding unit 400, places a document on the contact glass 32 of the scanner unit 300, and closes the document feeding unit 400 to hold the document. The operator then presses a start switch. If the document is placed on the document feeding unit 400, the document is fed onto the contact glass 32, and the scanner unit 300 starts to be driven. If the document is placed on the contact glass 32, the scanner unit 300 immediately starts to be driven. Then, the first carriage 33 and the second carriage 34 move, and light emitted from a light source of the first carriage 33 is reflected by a surface of the document and travels to the second carriage 34. The light is then reflected by mirrors of the second carriage 34, and reaches the reading sensor 36 through the imaging lens 35 to be read as image information.

After the image information is thus read, one of the support rollers 14, 15, and 16 in the printer unit 100 is driven to rotate by a drive motor. Thereby, the intermediate transfer belt 10 stretched around the support rollers 14, 15, and 16 is rotated to rotate the remaining two of the support rollers 14, 15, and 16. Then, the above-described laser writing process and a later-described development process are performed to form monochromatic toner images of the black, yellow, magenta, and cyan colors (hereinafter referred to as the K, Y, M, and C colors) on the rotating photoconductors 40K, 40Y, 40M, and 40C, respectively. In respective primary transfer nips for the K, Y, M, and C colors, in which the photoconductors 40K, 40Y, 40M, and 40C come into contact with the intermediate transfer belt 10, the monochromatic toner images are sequentially superimposed and electrostatically transferred (i.e., primary-transferred) onto the intermediate transfer belt 10 to form four-color superimposed toner images.

Meanwhile, to feed a transfer sheet having a size according to the image information, one of the three sheet feed rollers 42 in the sheet feeding unit 200 is driven to guide the transfer sheet to the sheet feed path 48 of the printer unit 100. The transfer sheet fed to the sheet feed path 48 is nipped by the registration roller pair 49 to be temporarily stopped. Thereafter, the transfer sheet is fed with appropriate timing to the secondary transfer nip corresponding to an area of contact between the intermediate transfer belt 10 and one of the support rollers 23 (i.e., the support roller 23 on the right side in FIG. 1) of the secondary transfer device 22 serving as a secondary transfer roller. Thereby, the transfer sheet and the four-color superimposed toner images on the intermediate transfer belt 10 enter the secondary transfer nip in synchronization, and come into close contact with each other. Then, the four-color superimposed toner images are secondary-transferred onto the transfer sheet by nip pressure and a transfer electric field generated in the secondary transfer nip, thereby forming a full-color image with white color of the transfer sheet.

With the rotation of the secondary transfer belt 24 of the secondary transfer device 22, the transfer sheet passes the secondary transfer nip and is fed to the fixing device 25. In the fixing device 25, the full-color image is fixed on the transfer sheet with pressure and heat applied by the pressure roller 27 and the heating belt 26, respectively. The transfer sheet is then discharged via the discharge roller pair 56 onto the sheet discharging tray 57 provided to a side surface of the printer unit 100.

Figure 2:
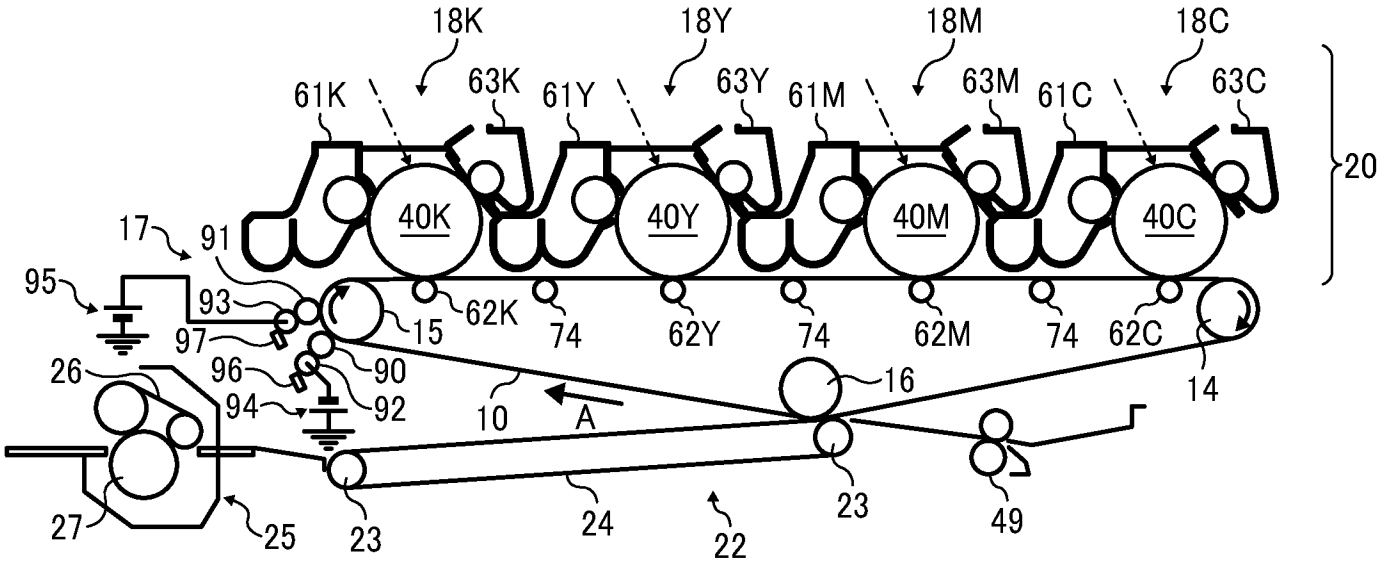
FIG. 2 is an enlarged configuration diagram of a printer unit of the copier.

FIG. 2 is an enlarged configuration diagram illustrating the printer unit 100. As described above, the printer unit 100 includes the belt unit including the intermediate transfer belt 10 and the support rollers 14, 15, and 16, the four process units 18K, 18Y, 18M, and 18C for forming the toner images of the respective colors, the secondary transfer device 22, the belt cleaning device 17, and the fixing device 25.

In the belt unit, the intermediate transfer belt 10 stretched around the support rollers 14, 15, and 16 is rotated while in contact with the photoconductors 40K, 40Y, 40M, and 40C. In the primary transfer nips for the K, Y, M, and C colors, in which the photoconductors 40K, 40Y, 40M, and 40C come into contact with the intermediate transfer belt 10, the primary transfer rollers 62K, 62Y, 62M, and 62C press the intermediate transfer belt 10 against the photoconductors 40K, 40Y, 40M, and 40C from the inner circumferential surface side of the intermediate transfer belt 10. Each of the primary transfer rollers 62K, 62Y, 62M, and 62C is supplied with a primary transfer bias by a power supply. In the primary transfer nips for the K, Y, M, and C colors, therefore, primary transfer electric fields are generated which electrostatically move the toner images on the photoconductors 40K, 40Y, 40M, and 40C toward the intermediate transfer belt 10. Between the primary transfer rollers 62K, 62Y, 62M, and 62C, conductive rollers 74 are provided to be in contact with the inner circumferential surface of the intermediate transfer belt 10. The conductive rollers 74 prevent the primary transfer bias supplied to the primary transfer rollers 62K, 62Y, 62M, and 62C from flowing into the adjacent process units 18K, 18Y, 18M, and 18C via a medium-resistance base layer provided on the inner circumferential surface of the intermediate transfer belt 10.

Each of the process units 18K, 18Y, 18M, and 18C serves as one unit which includes the corresponding one of the photoconductors 40K, 40Y, 40M, and 40C and some other devices supported by a common support member, and which is attachable to and detachable from the printer unit 100. For example, the process unit 18K for the black color includes, as well as the photoconductor 40K, a development device 61K and a photoconductor cleaning device 63K illustrated in FIG. 2 and a discharging device 64 and a charging device 60 not illustrated in FIG. 2 but illustrated in an enlarged view of FIG. 3. The development device 61K develops the electrostatic latent image formed on the outer circumferential surface of the photoconductor 40K to form a black toner image. The photoconductor cleaning device 63K cleans off post-transfer residual toner adhering to the outer circumferential surface of the photoconductor 40K having passed the primary transfer nip. The discharging device 64 discharges the cleaned outer circumferential surface of the photoconductor 40K. The charging device 60 uniformly charges the discharged outer circumferential surface of the photoconductor 40K. The process units 18Y, 18M, and 18C for the other colors are substantially similar in configuration to the process unit 18K except for the difference in color of toner contained therein. The present copier employs a so-called tandem configuration in which the four process units 18K, 18Y, 18M, and 18C are aligned in the rotation direction of the intermediate transfer belt 10 to face the intermediate transfer belt 10.

FIG. 3 is a partial enlarged view illustrating a part of the tandem unit 20 including the four process units 18K, 18Y, 18M, and 18C. The four process units 18K, 18Y, 18M, and 18C are substantially similar in configuration except for the difference in color of toner contained therein, as described above. In FIG. 3, therefore, the suffixes K, Y, M, and C following reference numerals are omitted. As illustrated in FIG. 3, a process unit 18 includes a photoconductor 40 surrounded by a charging device 60, a development device 61, a primary transfer roller 62 serving as a primary transfer device, a photoconductor cleaning device 63, and a discharging device 64.

The drum-shaped photoconductor 40 is, for example, an aluminum pipe coated with an organic photosensitive material to form a photosensitive layer. Alternatively, the photoconductor 40 may be an endless belt. The charging device 60 is a charging roller supplied with a charging bias and rotated while in contact with the photoconductor 40. Alternatively, the charging device 60 may be, for example, a scorotron charger which charges the photoconductor 40 in a non-contact manner.

The development device 61 develops the latent image with a two-component developer including magnetic carrier and non-magnetic toner. The development device 61 includes a mixing section 66 and a development section 67. The mixing section 66 mixes and transports the two-component developer contained therein to supply the two-component developer to a development sleeve 65. The development section 67 transfers the toner of the two-component developer adhering to the development sleeve 65 onto the photoconductor 40.

The mixing section 66 is located lower than the development section 67, and houses two screws 68 disposed to be parallel to each other, a dividing plate 69 provided between the screws 68, and a toner concentration sensor 71 provided to a bottom surface of a development case 70. The development section 67 houses the development sleeve 65 facing the photoconductor 40 through an opening formed in the development case 70, a magnet roller 72 non-rotatably provided inside the development sleeve 65, and a doctor blade 73 having a leading end located close to the development sleeve 65.

A minimum gap between the doctor blade 73 and the development sleeve 65 is set to approximately 500 μm. The development sleeve 65 is a rotatable non-magnetic sleeve member. The magnet roller 72 is configured not to rotate together with the development sleeve 65, and has five magnetic poles N1, S1, N2, S2, and S3, for example, along the rotation direction of the development sleeve 65 from a position corresponding to the doctor blade 73. At a predetermined position in the rotation direction, magnetic force of the magnetic poles N1, S1, N2, S2, and S3 acts on the two-component developer carried on the development sleeve 65. Thereby, the two-component developer transported from the mixing section 66 is attracted to and carried on an outer circumferential surface of the development sleeve 65, thereby forming a magnetic brush around the outer circumferential surface of the development sleeve 65 along lines of magnetic force.

With the rotation of the development sleeve 65, the magnetic brush passes a position facing the doctor blade 73, and thereby is regulated into an appropriate layer thickness. The magnetic brush is then moved to a development area facing the photoconductor 40, and is transferred onto the electrostatic latent image on the photoconductor 40 by the potential difference between a development bias supplied to the development sleeve 65 and the electrostatic latent image on the photoconductor 40. The thus-transferred magnetic brush contributes to the development process. Then, with the rotation of the development sleeve 65, the magnetic brush returns to the development section 67, separates from the outer circumferential surface of the development sleeve 65 owing to a repulsive magnetic field between the magnetic poles N1, S1, N2, S2, and S3 of the magnetic roller 72, and returns to the mixing section 66. In the mixing section 66, an appropriate amount of toner is supplied to the two-component developer on the basis of the detection result of the toner concentration sensor 71. In the development device 61, the two-component developer may be replaced by a one-component developer not including magnetic carrier.

The photoconductor cleaning device 63 includes a cleaning blade 75, a fur brush 76, an electric field roller 77 made of metal, a scraper 78, and a collecting screw 79. In the present embodiment, the photoconductor cleaning device 63 employs a system in which the cleaning blade 75 made of polyurethane rubber is pressed against the photoconductor 40. Alternatively, the photoconductor cleaning device 63 may employ a different system. To improve cleaning performance, the photoconductor cleaning device 63 of the present embodiment employs the contact-type conductive fur brush 76 having an outer circumferential surface in contact with the photoconductor 40 and rotatable in the direction of arrow B in FIG. 3. Further, the electric field roller 77 for supplying a bias to the fur brush 76 is disposed to be rotatable in the direction of arrow C in FIG. 3, and a leading end of the scraper 78 is pressed against the electric field roller 77. The toner removed from the electric field roller 77 by the scraper 78 falls on and collected by the collecting screw 79.

In the thus-configured photoconductor cleaning device 63, the residual toner remaining on the photoconductor 40 is removed by the fur brush 76 rotating in the counter direction against the photoconductor 40. The toner adhering to the fur brush 76 is removed by the electric field roller 77 supplied with a bias and rotating while in contact with the fur brush 76 in the counter direction. The toner adhering to the electric field roller 77 is cleaned off by the scraper 78. The toner collected by the photoconductor cleaning device 63 is moved to a corner of the photoconductor cleaning device 63 by the collecting screw 79, and is returned to the development device 61 by a toner recycling device 80 to be recycled.

The discharging device 64 includes, for example, a discharging lamp to irradiate the outer circumferential surface of the photoconductor 40 with light and thereby discharge the surface potential of the photoconductor 40. The thus-discharged outer circumferential surface of the photoconductor 40 is uniformly charged by the charging device 60, and then is subjected to the optical writing process.

As illustrated in FIG. 2, the secondary transfer device 22 is provided under the belt unit. In the secondary transfer device 22, the secondary transfer belt 24 is stretched and rotated between the two support rollers 23. One of the support rollers 23 (i.e., the support roller 23 on the right side in FIG. 2) serving as the secondary transfer roller is supplied with a secondary transfer bias by a power supply, and the intermediate transfer belt 10 and the secondary transfer belt 24 are nipped between the support roller 23 and the support roller 16 of the belt unit. Thereby, the secondary transfer nip is formed in which the intermediate transfer belt 10 and the secondary transfer belt 24 move in the same direction while in contact with each other. Due to a secondary transfer electric filed and nip pressure, the four-color superimposed toner images on the intermediate transfer belt 10 are secondary-transferred at one time onto the transfer sheet fed to the secondary transfer nip from the registration roller pair 49, thereby forming a full-color image. The transfer sheet passes the secondary transfer nip, and separates from the intermediate transfer belt 10. Then, with the rotation of the secondary transfer belt 24, the transfer sheet carried on the outer circumferential surface of the secondary transfer belt 24 is fed to the fixing device 25. The support roller 23 serving as the secondary transfer roller may be replaced by, for example, a transfer charger to perform the secondary transfer.

Meanwhile, the outer circumferential surface of the intermediate transfer belt 10 passes the secondary transfer nip, and reaches a position at which the intermediate transfer belt 10 is supported by the support roller 15. At the position, the intermediate transfer belt 10 is nipped between the belt cleaning device 17 in contact with the outer circumferential surface (i.e., outer loop surface) of the intermediate transfer belt 10 and the support roller 15 in contact with the inner circumferential surface of the intermediate transfer belt 10, and post-transfer residual toner adhering to the outer circumferential surface of the intermediate transfer belt 10 is removed by the belt cleaning device 17. Thereafter, the intermediate transfer belt 10 sequentially enters the primary transfer nips for the K, Y, M, and C colors, and the next toner images of the four colors are superimposed on the intermediate transfer belt 10.

The belt cleaning device 17 includes two fur brushes 90 and 91, metal rollers 92 and 93, power supplies 94 and 95, and blades 96 and 97. The fur brushes 90 and 91 rotate while in contact with the intermediate transfer belt 10 in the counter direction against the implanting direction of bristles of the fur brushes 90 and 91, to thereby mechanically scrape the post-transfer residual toner off the intermediate transfer belt 10. Further, each of the fur brushes 90 and 91 is supplied with a cleaning bias by a power supply to electrostatically attract and collect the scraped post-transfer residual toner.

The metal rollers 92 and 93 are in contact with the fur brushes 90 and 91, respectively, and rotate in a direction the same as or opposite to the rotation direction of the fur brushes 90 and 91. The metal roller 92 located upstream of the metal roller 93 in the rotation direction of the intermediate transfer belt 10 is supplied with a voltage of negative polarity by the power supply 94. The metal roller 93 located downstream of the metal roller 92 in the rotation direction of the intermediate transfer belt 10 is supplied with a voltage of positive polarity by the power supply 95. The metal rollers 92 and 93 are in contact with a leading end of the blade 96 and a leading end of the blade 97, respectively. In this configuration, the upstream fur brush 90 first cleans the outer circumferential surface of the intermediate transfer belt 10 with the rotation of the intermediate transfer belt 10 in the direction of arrow A in FIG. 2. In this process, the fur brush 90 is supplied with a voltage of approximately −400 V, while the metal roller 92 is supplied with a voltage of approximately −700 V, for example. Thereby, toner of positive polarity on the intermediate transfer belt 10 is electrostatically transferred to the fur brush 90. Then, the toner is further transferred to the metal roller 92 from the fur brush 90 by the potential difference therebetween, and is scraped off by the blade 96.

Some of the toner on the intermediate transfer belt 10 is thus removed by the fur brush 90, but some of the toner still remains on the intermediate transfer belt 10. Such toner is negatively charged by the bias of negative polarity supplied to the fur brush 90. Then, the downstream fur brush 91 supplied with the bias of positive polarity performs cleaning to remove the toner. The removed toner is transferred from the fur brush 91 to the metal roller 93 by the potential difference therebetween, and is scraped off by the blade 97. The toner scraped off by the blades 96 and 97 is collected in a tank. After the cleaning by the fur brush 91, most of the toner on the intermediate transfer belt 10 is removed. However, a slight amount of the toner still remains on the intermediate transfer belt 10. Such toner still remaining on the intermediate transfer belt 10 is charged to the positive polarity by the bias of positive polarity supplied to the fur brush 91, as described above. The toner is then transferred to the photoconductors 40K, 40Y, 40M, and 40C by the transfer electric fields generated in the respective primary transfer nips, and is collected by the photoconductor cleaning devices 63K, 63Y, 63M, and 63C.

Returning to FIG. 1, the registration roller pair 49 is commonly used as grounded, but may be supplied with a bias to remove paper dust arising from the transfer sheet. Further, the transfer sheet reversing device 28 extending parallel to the tandem unit 20 is provided below the secondary transfer device 22 and the fixing device 25. With this configuration, the transfer sheet having one surface subjected to the image fixing process is shifted toward the transfer sheet reversing device 28 by the switching member 55, reversed by the transfer sheet reversing device 28, and is again fed to the secondary transfer nip. Then, the other surface of the transfer sheet is subjected to the secondary transfer process and the image fixing process, and is discharged onto the sheet discharging tray 57.

Description will now be given of examples of predetermined physical properties of the copier detected in the present embodiment. FIG. 4 is a control block diagram of the copier. The copier has a control system including, for example, a controller 1, sensors 2, and an operation display unit 3, and is connectable to a modem 500 for subsequent information transmission. The controller 1 is a control device which performs overall control of the copier, and includes a read-only memory (ROM) 1*c*, a random access memory (RAM) 1*b*, a central processing unit (CPU) 1*a*, and a nonvolatile RAM 1*d*, for example. The ROM 1*c* serves as a data storage device which sores control programs. The RAM 1*b* serves as a data storage device which stores, for example, operation data and control parameters. The CPU 1*a* serves as an arithmetic processor. The nonvolatile RAM 1*d* serves as a data storage device. The operation display unit 3 includes, for example, a display unit and an operation unit. The display unit includes, for example, a liquid crystal display which displays information such as text information. The operation unit receives information input by an operator through, for example, numeric keys, and transmits the input information to the controller 1.

The controller 1 and the sensors 2 together form a physical property detector which detects a variety of physical properties, such as residual potential on the outer circumferential surface of the photoconductor 40 (i.e., post-discharge photoconductor surface potential). As well as the physical properties, the controller 1 and the sensors 2 further acquire information useful in the control of the image forming operation and the processing and maintenance of the copier (e.g., abnormality prediction). Such physical properties and information (hereinafter collectively referred to as the properties) include, for example, (a) sensing information, (b) control parameter information, and (c) input image information, which will be described below.

(a) Sensing information includes, for example, driving information, transfer sheet feeding state, transfer sheet properties, developer properties, photoconductor properties, electrophotographic processing state, toner image properties, physical properties of the printed material, and environmental conditions, which will be summarized below.

(a-1) Driving information includes, for example, the photoconductor rotation speed detected by an encoder, the values of current and temperature of a drive motor, the driving state of a cylindrical or belt-shaped rotary component, such as a heating belt, a sheet feed roller, and a drive roller, and driving sound detected by a microphone installed inside or outside the copier.

(a-2) Transfer sheet feeding state includes, for example, the position of the leading or tailing end of the fed transfer sheet, a sheet jam, a change in passage time of the leading or tailing end of the transfer sheet, and a positional change of the transfer sheet in a direction perpendicular to the sheet feeding direction, which are detected by a transmissive or reflective optical sensor or a contact-type sensor. Transfer sheet feeding state further includes the moving speed of the transfer sheet calculated from the times of detection of the transfer sheet by multiple sensors, and slippage between a sheet feed roller and the transfer sheet in the sheet feeding process calculated by comparison between the measured number of rotations of the sheet feed roller and the travel distance of the transfer sheet.

(a-3) Transfer sheet properties, which substantially affect the image quality and the stability of sheet feeding performance, includes, for example, thickness, surface roughness, glossiness, rigidity, moisture amount, curl amount, and electrical resistance of the transfer sheet, and the type of the transfer sheet, such as a recycled sheet, a sheet printed on one side, or an overhead projector (OHP) sheet. The thickness of the transfer sheet is obtained by, for example, causing an optical sensor to detect a relative change in position of two rollers nipping the transfer sheet, or by detecting a displacement amount corresponding to the amount of movement of a component raised by the transfer sheet fed thereto. The surface roughness of the transfer sheet is obtained by detecting vibration or friction sound generated when a surface of the transfer sheet before being subjected to the transfer process comes into contact with, for example, a guide member. The glossiness of the transfer sheet is obtained by causing a beam with a predetermined aperture angle to be incident on the transfer sheet at a predetermined incident angle, and causing a sensor to measure the beam with a predetermined aperture angle reflected in a specular reflection direction. The rigidity of the transfer sheet is obtained by detecting the deformation amount (i.e., bent amount) of the pressed transfer sheet. The moisture amount of the transfer sheet is obtained by measuring absorption of infrared or microwave light. The curl amount of the transfer sheet is detected by an optical sensor or a contact sensor. The electrical resistance of the transfer sheet is directly measured by a pair of electrodes of, for example, sheet feed rollers made in contact with the transfer sheet, or is estimated from the measurement value of the surface potential of the photoconductor 40 or the intermediate transfer belt 10 after the image transfer to the transfer sheet. Whether or not the transfer sheet is a recycled sheet is determined by irradiating the transfer sheet with ultraviolet light and detecting the transmittance of the light. Whether or not the transfer sheet is a sheet printed on one side is determined by emitting light from a linear light source, such as a light-emitting diode (LED) array, and causing a solid-state image sensing device, such as a charge-coupled device (CCD), to detect the light reflected by a transfer surface of the transfer sheet. Whether or not the transfer sheet is an OHP sheet is determined by irradiating the transfer sheet with light and detecting regularly reflected light different in angle from transmitted light.

(a-4) Developer properties, i.e., properties of the developer (i.e., toner and carrier) in the copier affect the fundamental function of the electrophotographic processing, acting as important factors in the operation and output of the image forming system. It is therefore important to obtain the information of the developer. The developer properties include, for example, toner charge, distribution of toner charge, toner fluidity, toner cohesiveness, toner bulk density, electrical resistance of toner, amount of additive in toner, amount of consumed or remaining toner, toner concentration (i.e., mixing ratio of toner and carrier), magnetic properties of carrier, coating layer thickness of carrier, and spent amount of carrier. Normally, it is difficult to detect each of these properties by itself in the copier, and thus these properties may be detected as overall properties of the developer. The overall properties of the developer may be measured as follows, for example. That is, a test latent image is formed on the photoconductor 40 and developed under a predetermined development condition to form a toner image, and the reflection density (i.e., optical reflectance) of the formed toner image is measured. Further, the relationship between supplied voltage and current (e.g., resistance or permittivity) is measured by a pair of electrodes provided in the development device 61, and a voltage-current characteristic (e.g., inductance) is measured by a coil provided in the development device 61. Further, the developer capacity is detected by a level sensor provided in the developer device 61. The level sensor may be an optical or capacitance sensor.

(a-5) Photoconductor properties are also closely related to the function of the electrophotographic processing, similarly to the developer properties. The photoconductor properties include, for example, layer thickness, surface properties (e.g., coefficient of friction and irregularities), uniform charge potential, residual potential, surface energy, diffused light, temperature, color, surface position (or change in surface position), linear velocity, potential attenuation speed, electrical resistance, capacitance, and surface moisture amount of the photoconductor 40. Some of these properties are detected as follows in the copier. For example, current flowing from the charging device 60 to the photoconductor 40 is detected to detect a change in capacitance according to a change in layer thickness of the photoconductor 40, and a voltage supplied to the charging device 60 is compared with a voltage-current characteristic corresponding to a predetermined dielectric thickness of the photoconductor 40, to thereby calculate the layer thickness. The residual potential and temperature are detected by a common sensor. The linear velocity is detected by, for example, an encoder attached to a rotary shaft of the photoconductor 40. The diffused light from the outer circumferential surface of the photoconductor 40 is detected by an optical sensor.

(a-6) Electrophotographic processing state, i.e., the information of respective processes of the electrophotographic toner image formation substantially affects images and other outputs of the image forming system. In the electrophotographic toner image formation, uniform charging of the photoconductor 40, formation of a latent image with, for example, laser light (i.e., image exposure), development of the image with charged toner (i.e., colored particles) to form a toner image, transfer of the toner image to a transfer sheet, and fixing of the toner image on the transfer sheet are sequentially performed. It is important to acquire the information of the above-described processes of the electrophotographic toner image formation to evaluate the stability of the image forming system. The information of electrophotographic processing state includes, for example, charge potential, exposed portion potential, a gap between the charging device 60 and the photoconductor 40 (in a case in which the charging device 60 is configured as a non-contact type charging device), electromagnetic waves and sound generated by the charging process, exposure intensity, and exposure light wavelength. The charge potential and the exposed portion potential are detected by a common surface potential sensor. The gap between the charging device 60 and the photoconductor 40 is detected by measuring a light amount passing the gap. The electromagnetic waves are captured by a wide-band antenna.

(a-7) Toner image properties includes, for example, pile height (i.e., height of toner image), toner charge, dot fluctuation or dot blurring, post-fixing offset amount of toner image, post-transfer residual toner amount, and color unevenness in superimposed toner images. The pile height is obtained by causing a displacement sensor to measure the depth of the toner image in the vertical direction, and causing a parallel beam linear sensor to measure the length of a light-shielded portion in the horizontal direction. The toner charge is obtained by causing a potential sensor to measure the potential of an electrostatic latent image as developed, and calculating the ratio of the potential to a toner adhesion amount calculated from the detection result of a reflection density sensor provided at the same position. The dot fluctuation or dot blurring is detected by causing an infrared area sensor to detect a dot pattern image on the photoconductor 40 or causing an area sensor with a waveform according to the corresponding color to detect a dot pattern image on the intermediate transfer belt 10, and performing appropriate processing on the detection result. The post-fixing offset amount of the toner image is detected by comparing the position of the toner image on the transfer sheet and the corresponding position on the heating belt 26 each detected by an optical sensor. The post-transfer residual toner amount is calculated from the amount of light reflected by a post-transfer residual image pattern of a specific pattern detected by an optical sensor on the photoconductor 40 or the intermediate transfer belt 10 after the transfer process. The color unevenness in superimposed toner images is detected by a full-color sensor which detects the transfer sheet after the fixing process.

The toner image properties further includes image density, color, gradation, clarity, graininess (i.e., granularity), registration skew, color shift, banding (i.e., uneven density in the sheet feeding direction), glossiness (or unevenness thereof), and fog. The image density and color of the toner image are optically detected with the use of reflected light or transmitted light. The wavelength of irradiating light may be selected in accordance with the color. The image density and single color information may be detected on the photoconductor 40 or the intermediate transfer belt 10, while the measurement of color combination to detect, for example, color unevenness is performed on the transfer sheet. The gradation is detected by causing an optical sensor to detect reflection densities of toner images of different gradation levels formed on the photoconductor 40 or transferred to the intermediate transfer belt 10. The clarity is detected by causing a monocular sensor having a relatively small spot diameter or a high-resolution line sensor to read developed or transferred images of repeated line patterns. The graininess is detected by reading a halftone image in a similar manner as in the detection of clarity and calculating a noise component. The registration skew is calculated by providing two optical sensors at respective positions downstream of the registration roller pair 49 in the sheet feeding direction and corresponding to the opposed ends of the transfer sheet in a main scanning direction, and calculating the difference between the sensors in the time from the turn-on of the registration roller pair 49 to the detection by the sensors. The color shift is detected by causing a monocular small-diameter spot sensor or a high-resolution line sensor to detect an edge portion of superimposed images on the intermediate transfer belt 10 or the transfer sheet. The banding is detected by causing a small-diameter spot sensor or a high-resolution line sensor to measure uneven density of the toner image on the transfer sheet in a sub-scanning direction, and measuring the amount of signals having a specific frequency. The glossiness is detected by causing a regular reflection optical sensor to detect a uniform image formed on the transfer sheet. The fog is detected by causing an optical sensor for detecting a relatively large area to read an image background area on the photoconductor 40, the intermediate transfer belt 10, or the transfer sheet, or by causing a high-resolution area sensor to acquire image information of respective sections of the background area and counting the number of toner particles included in the image thereof.

(a-8) Physical properties of the printed material (i.e., printed transfer sheet) output by the copier include, for example, image tailing, image blurring, toner blur, tailing white space, and solid cross white space in the transfer sheet, curling, cockling, and folding of the transfer sheet, and stain and scratch on a side surface of the transfer sheet. The image tailing and image blurring are identified by causing an area sensor to detect the toner image on the photoconductor 40, the intermediate transfer belt 10, or the transfer sheet, and performing image processing on acquired image information of the toner image. The toner blur is identified by causing a high-resolution line sensor or an area sensor to read a pattern image on the transfer sheet, and calculating the amount of toner dispersed around the pattern image. The tailing white space and solid cross white space are detected by a high-resolution line sensor on the photoconductor 40, the intermediate transfer belt 10, or the transfer sheet. The curling, cockling, and folding of the transfer sheet are detected by a displacement sensor. To detect the folding, it is effective to dispose the sensor near the opposed ends of the transfer sheet. The stain and scratch on a side surface of the transfer sheet is identified by analyzing the image of a side surface of a bundle of discharged transfer sheets detected by an area sensor vertically provided to the sheet discharging tray 57.

(a-9) Environmental conditions include, for example, temperature, humidity, a variety of gasses, airflow (e.g., direction, flow rate, and type thereof), atmospheric pressure, pressure, and vibration. The temperature is detected by, for example, a thermocouple system that extracts, as a signal, thermoelectromotive force generated at a point of contact between different metals or between a metal and a semiconductor, a variable resistivity element that uses a change in resistivity of metal or semiconductor with temperature, a pyroelectric element that uses a certain type of crystal in which the charge configuration is changed by an increase in temperature to thereby generate a surface potential, or a thermomagnetic effect element that detects a change in magnetic characteristics due to temperature. The humidity is detected by, for example, a an optical measurement method of measuring optical absorption of $H_2O$ or OH group, or a humidity sensor which measures a change in electrical resistance of a material due to adsorption of water vapor. Each of the gases is basically detected by measuring a change in electrical resistance of an oxide semiconductor due to adsorption of the gas. The airflow may be detected by an optical measurement method. In the present embodiment, however, a small-sized air-bridge type flow sensor is particularly useful to be installed in the image forming system. The atmospheric pressure and pressure are detected by, for example, a method using a pressure-sensitive material or a method of measuring a mechanism displacement of a membrane. The vibration is also detected by a similar method.

(b) Control parameter information includes parameters input to or output from the controller 1. Since the operation of the copier is determined by the controller 1, it is effective to directly use the parameters input to or output from the controller 1. The control parameter information includes, for example, image forming parameters, user operation history, power consumption, expendable consumption information, abnormality occurrence information, and cumulative operation time information, which will be summarized below.

(b-1) Image forming parameters include direct parameters output in arithmetic processing by the controller 1 to form an image. The direct parameters include, for example, values of image forming conditions set by the controller 1, such as values of charge potential, development bias, and fixing temperature. The image forming parameters further include set values of parameters for a variety of image processing, such as halftone processing and color correction, and a variety of parameters set by the controller 1 to operate the copier, such as a sheet feeding time and a standby mode execution time preceding the image forming operation.

(b-2) User operation history includes, for example, the frequency of each of various operations selected, such as an operation to instruct the number of colors, the number of prints, or image quality, and the frequency of each of sheet sizes selected.

(b-3) Power consumption includes, for example, total power consumption in the entire period or a specific period (e.g., day, week, or month), and distribution, variation (i.e., deviation), and cumulative sum (i.e., integration) of the power consumption.

(b-4) Expendable consumption information includes, for example, the usage of each of the toner, the photoconductor 40, and the transfer sheet in the entire period or a specific period (e.g., day, week, or month), and distribution, variation (i.e., deviation), and cumulative value (i.e., integration) of the usage. A photoconductor count representing the usage of the photoconductor 40 is stored in the nonvolatile RAM 1*d* by the CPU 1*a* of the controller 1. Thus, the nonvolatile RAM 1*d* serves as a cumulative usage information storage device. Normally, the photoconductor count is manually reset (i.e., cleared) when the photoconductor 40 is replaced with a new photoconductor 40, and the information of the time of reset is stored in the nonvolatile RAM 1*d* by the CPU 1*a*. Thus, the nonvolatile RAM 1*d* also serves as a reset time storage device, and the CPU 1*a* serves as a cumulative usage resetting device.

(b-5) Abnormality occurrence information includes, for example, the frequency of each of different types of abnormalities occurring in the entire period or a specific period (e.g., day, week, or month), and distribution, variation (i.e., deviation), and cumulative value (i.e., integration) of the frequency.

(b-6) Cumulative operation time information includes, for example, cumulative operation time of each of components such as the process units 18K, 18Y, 18M, and 18C (hereinafter collectively referred to as the process units 18), the intermediate transfer belt 10, the respective rollers, the belt cleaning device 17, and the fixing device 25, which is measured and stored in the nonvolatile RAM 1*d* by the controller 1. Each of the process units 18 for the respective colors is attachable to and detachable from the body of the copier as one process unit, and is allowed to be disassembled into the development device 61, the charging device 60, and a photoconductor unit holding the other components, when removed from the body of the copier. The replacement of components is not limited to the replacement of the process unit 18 as a whole, and the development device 61, the charging device 60, and the photoconductor unit are individually replaceable. Therefore, the cumulative operation time is measured not for the entire process unit 18 but for each of the development device 61, the charging device 60, and the photoconductor unit. Further, the cumulative print number is counted as the cumulative operation time. The cumulative print number is incremented by one for each operation of making one print.

(c) Input image information includes, for example, cumulative colored pixel number, ratio of color text, toner consumption distribution, image size, and text type (e.g., size and font thereof), which are acquired from image information directly transmitted as data from a host computer or image information of the image of a document read by the scanner unit 3 and image-processed. The cumulative colored pixel number is obtained by counting the pixels of the image data for each of the GRB signals. For example, an original image may be separated into text, halftone dots, photographs, and background to calculate the ratio of, for example, a text or halftone portion in accordance with a method disclosed in Japanese Patent No. 2621879. The ratio of color text may be calculated in a similar manner. The toner consumption distribution in the main scanning direction is obtained by counting the cumulative colored pixel number for each of regions of the image divided in the main scanning direction. The image size is obtained from an image size signal generated by the controller 1 or from the distribution of colored pixels of the image data. The text type is obtained from attribute data on the text.

Description will now be given of a specific method of acquiring the properties from the copier.

(1) Temperature information is acquired by a temperature sensor provided to the present copier, which is a microsensor simple in principle and structure employing a variable resistance element.

(2) Humidity is detected by a small-sized humidity sensor, according to a basic principle of which, upon adsorption of water vapor by a humidity-sensitive ceramics, ion conduction is increased by the adsorbed water, reducing the electrical resistance of the ceramics. The humidity-sensitive ceramics is made of a porous material normally including an alumina-based material, an apatite-based material, and a $ZrO_2$—MgO-based material, for example.

(3) Vibration is detected by a vibration sensor basically similar to a sensor for measuring pressure or atmospheric pressure. A micro vibration sensor using silicon is particularly useful to be installed in the image forming system. With the vibration sensor, the movement of an oscillator formed on a relatively thin silicon (Si) diaphragm is measured from a change in capacitance between the oscillator and a counter electrode provided facing the oscillator, or is measured with the use of the piezoresistance effect of the Si diaphragm.

(4) Toner concentration is detected for each of the four colors. The toner concentration may be detected by a toner concentration sensor of a common system, such as a sensing system disclosed in Japanese Laid-Open Patent Application No. 6-289717 (JP-H06-289717-A), for example, which measures a change in magnetic permeability of a developer in a development device to thereby detect the toner concentration.

(5) Photoconductor uniform charge potential is detected for each of the photoconductors 40K, 40Y, 40M, and 40C for the four colors. The photoconductor uniform charge may be detected by a common surface potential sensor which detects the surface potential of an object.

(6) Photoconductor post-exposure potential, i.e., the photoconductor surface potential after optical writing, is detected for each of the photoconductors 40K, 40Y, 40M, and 40C for the four colors in a similar manner to that for the photoconductor uniform charge potential.

(7) Photoconductor residual potential, i.e., the photoconductor surface potential after the discharging process by the discharging device 64, is detected for each of the photoconductors 40K, 40Y, 40M, and 40C for the four colors in a similar manner to that for the photoconductor uniform charge potential.

(8) Colored area ratio is calculated for each of the four colors from the ratio of the sum of pixels to be colored to the sum of all pixels included in the input image information.

(9) Development toner amount, i.e., the toner adhesion amount per unit area, is calculated for each of the toner images of the four colors respectively developed on the photoconductors 40K, 40Y, 40M, and 40C on the basis of the optical reflectance detected by a reflective photosensor. The reflective photosensor irradiates a target object with LED light, and detects reflected light with a light-receiving element. The toner adhesion amount is correlated with the optical reflectance, and thus is calculated on the basis of the optical reflectance.

(10) Skew of the leading end of the transfer sheet is detected as follows. A sheet feed path extending from a sheet feed roller 42 of the sheet feeding unit 200 to the secondary transfer nip is provided with a pair of optical sensors which detect the lateral sides of the transfer sheet, i.e., the opposed ends of the transfer sheet in a direction perpendicular to the sheet feeding direction, to thereby detect the lateral sides of the fed transfer sheet near the leading end of the transfer sheet. For each of the optical sensors, the time from the transmission of a drive signal for driving the sheet feed roller 42 to the passage of the transfer sheet through the optical sensor is measured. Then, the skew of the transfer sheet relative to the sheet feeding direction is calculated on the basis of the difference in measurement time between the optical sensors.

(11) Sheet discharge time is detected by an optical sensor which detects the transfer sheet having passed the sheet discharge roller pair 56. Also in this case, the sheet discharge time is measured with reference to the time of transmission of the drive signal for driving the sheet feed roller 42.

(12) Total photoconductor current, i.e., current flowing from a photoconductor to ground, is detected for each of the photoconductors 40K, 40Y, 40M, and 40C for the four colors. The current may be detected by a current measuring device provided between a substrate of each of the photoconductors 40K, 40Y, 40M, and 40C and a ground terminal.

(13) Photoconductor drive power, i.e., drive power (i.e., product of current and voltage) consumed during the driving of a photoconductor drive source such as a motor, is detected for each of the photoconductors 40K, 40Y, 40M, and 40C for the four colors by, for example, an ammeter or a voltmeter.

The controller 1 periodically samples the above-described properties and stores, in an appending manner, the sampled properties in the nonvolatile RAM 1*d* serving as a data storage device.

Figure 5:
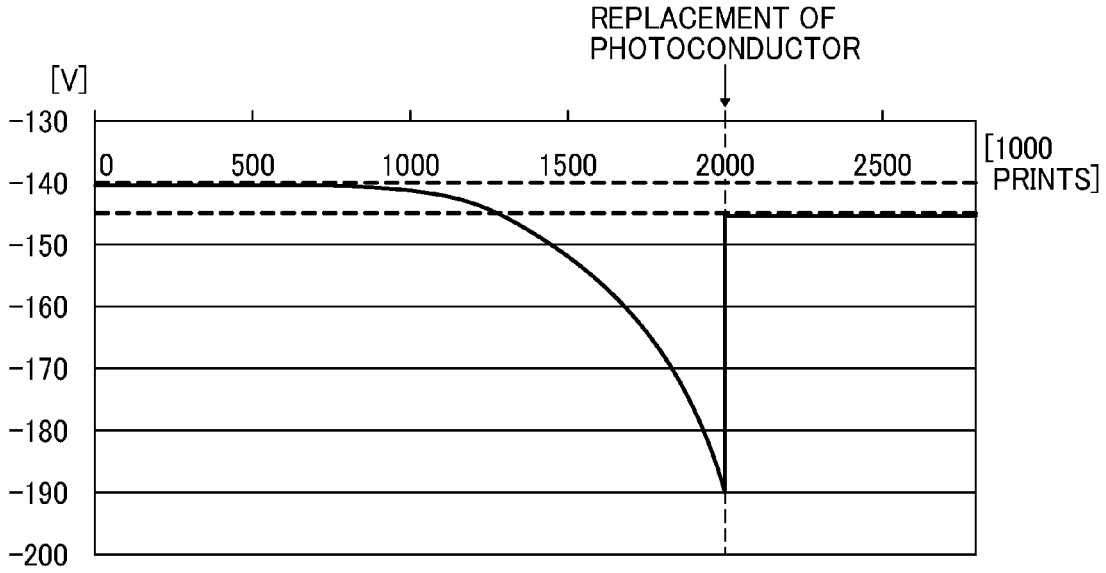
FIG. 5 is a graph illustrating an overview of the relationship between photoconductor residual potential and cumulative print number before and after photoconductor replacement.

Description will now be given of a method of detecting the time of replacement of the photoconductor 40 with a new photoconductor 40. FIG. 5 is a graph illustrating an overview of the relationship between the photoconductor residual potential and the cumulative print number before and after the replacement of the photoconductor 40. In the graph, the horizontal axis represents the cumulative print number, and the vertical axis represents the photoconductor residual potential. The photoconductor residual potential refers to the photoconductor surface potential generated by residual charge remaining on the outer circumferential surface of the photoconductor 40, without being discharged in the discharging process by the discharging device 64 in preprocessing of the charging process on the photoconductor 40. Normally, the amount of residual charge not discharged by the discharging process and remaining on the outer circumferential surface of the photoconductor 40 tends to increase with repeated use of the photoconductor 40.

An increase in cumulative print number results in degradation of the photoconductor 40 and an increase in residual charge, and thus the value of the residual potential of the negatively charged photoconductor 40 is reduced. When the photoconductor 40 reaches the end of the life and is replaced with a new photoconductor 40, the photoconductor residual potential sharply increases in value. It is therefore possible to estimate the photoconductor replacement time by detecting the time of such a change in residual potential.

The initial photoconductor residual potential varies among photoconductors. Also in the example illustrated in FIG. 5, the initial photoconductor residual potential is different between the replaced photoconductor 40 and the replacing photoconductor 40. The value of the initial photoconductor residual potential may be used as information for reducing the influence of individual differences among photoconductors, serving as useful information for analyzers. The initial photoconductor residual potential of the replacing photoconductor 40 is obtainable by detecting the photoconductor replacement time.

As described above, the photoconductor residual potential is data which noticeably changes before and after the replacement of the photoconductor 40. Among the variety of physical properties included the properties acquired as described above, therefore, the data on the photoconductor residual potential is used as a specific physical property in the present embodiment to detect the replacement time of the photoconductor 40. The specific physical property used to detect the replacement time of the photoconductor 40 is, for example, an electrical, mechanical, optical, thermal, or magnetic physical property of a component or material forming the present copier. The specific physical property is not limited to the photoconductor residual potential, and may be any other physical property which significantly changes before and after the replacement of the photoconductor 40.

Figure 6:
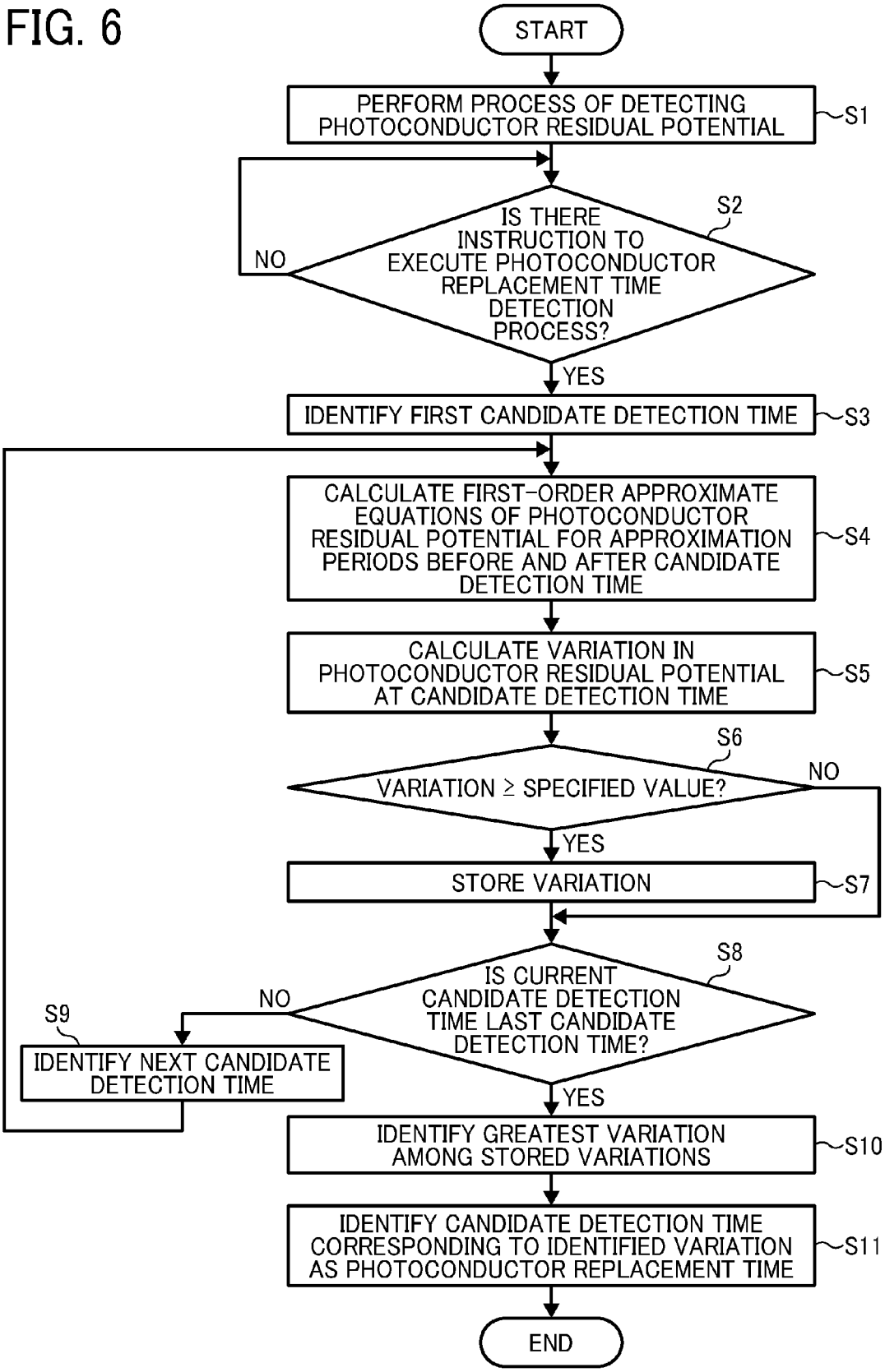
FIG. 6 is a flowchart illustrating a photoconductor replacement time detection process according to an embodiment of the present invention.

FIG. 6 is a flowchart illustrating a photoconductor replacement time detection process according to the present embodiment. The controller 1 of the present embodiment performs a process of detecting the photoconductor residual potential (step S1). In this process, on the basis of a signal output from a potential sensor which detects the photoconductor residual potential, the controller 1 intermittently detects the photoconductor residual potential at predetermined intervals (intervals of 1,000 prints in the present embodiment), and stores the detection data in the nonvolatile RAM 1*d* in an appending manner. Upon receipt of an instruction to execute the photoconductor replacement time detection process (YES at step S2), the controller 1 serving as a latent image carrier replacement time detector executes the photoconductor replacement time detection process as follows.

The controller 1 identifies a first candidate detection time in a detection period of the photoconductor replacement time detection process according to the execution instruction (step S3). In the present embodiment, the first candidate detection time is determined as the earliest candidate detection time in the detection period. Thereafter, the controller 1 reads, from the nonvolatile RAM 1*d*, the data on photoconductor residual potential corresponding to a predetermined approximation period preceding the first candidate detection time and the data on photoconductor residual potential corresponding to a predetermined approximation period subsequent to the first candidate detection time. The controller 1 then calculates, for each of the data on photoconductor residual potential corresponding to the preceding approximation period and the data on photoconductor residual potential corresponding to the subsequent approximation period, an approximate equation approximated to a linear function (step S4). In the present embodiment, an approximate equation $y=ax+b$ representing the photoconductor residual potential is calculated by the least squares method.

Figure 7:
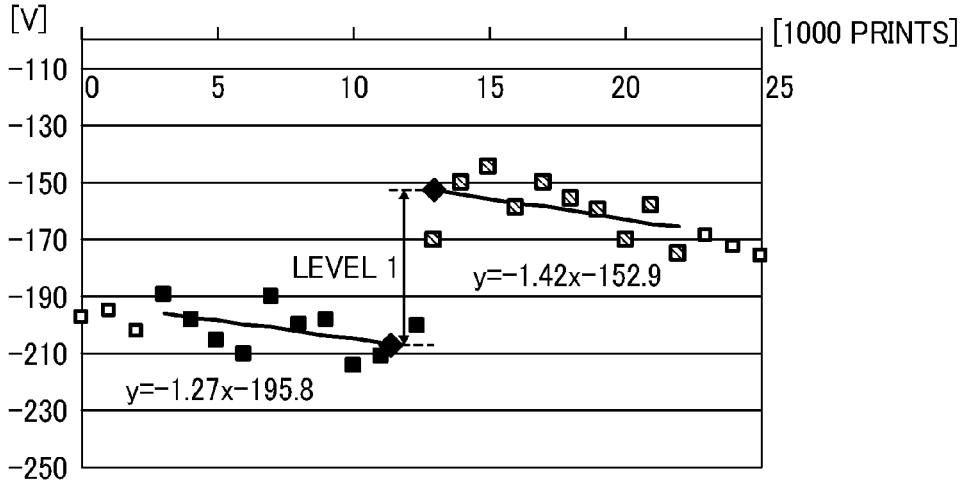
FIG. 7 is a graph plotting detection data on the photoconductor residual potential before and after the photoconductor replacement.

FIG. 7 is a graph plotting detection data on the photoconductor residual potential before and after the replacement of the photoconductor 40. In the graph, the horizontal axis represents the cumulative print number, and the vertical axis represents the photoconductor residual potential. Herein, the time of starting to use a new photoconductor 40 does not match the time at which the cumulative print number is zero. The graph illustrates two approximate equations (i.e., approximate linear lines) corresponding to an approximation period preceding the time of actual replacement of the photoconductor 40 and an approximation period subsequent to the time of actual replacement of the photoconductor 40, respectively. In the illustrated example, the photoconductor 40 is replaced between a cumulative print number of 12,000 and a cumulative print number of 13,000. Further, each approximation period corresponds to 10,000 prints, and the photoconductor residual potentials at ten points are approximated by the least squares method. In the example illustrated in FIG. 7, a first approximate equation for an approximation period from a cumulative print number of 3,000 to a cumulative print number of 12,000 is expressed as $y=-1.27\times-195.8$, and a second approximate equation for an approximation period from a cumulative print number of 13,000 to a cumulative print number of 22,000 is expressed as $y=-1.42\times-152.9$. It is observed from the graph illustrated in FIG. 7 that there is a substantial difference between the approximate value of the first approximate equation at the end of the preceding approximation period corresponding to the cumulative print number of 12,000 and the approximate value of the second approximate equation at the beginning of the subsequent approximation period corresponding to the cumulative print number of 13,000. In the present embodiment, therefore, the controller 1 calculates the value of the difference as a variation in residual potential due to the photoconductor replacement (step S5). Then, the controller 1 determines whether or not the magnitude (i.e., absolute value) of the variation is equal to or greater than a predetermined specified value (step S6). If the variation is determined to be equal to or greater than the specified value (YES at step S6), it is highly possible that the photoconductor replacement has taken place at the time of the variation, i.e., the candidate detection time corresponding to the variation. The controller 1 therefore stores the variation in the RAM 1*b* (step S7).

Then, the controller 1 determines whether or not the first candidate detection time is the last candidate detection time in the detection period (step S8). If it is determined that the first candidate detection time is not the last candidate detection time in the detection period (NO at step S8), the controller 1 identifies the second earliest candidate detection time in the detection period (step S9), and performs the above-described processes of steps S4 to S7 on the second earliest candidate detection time. Thereafter, the controller 1 sequentially performs the processes of steps S4 to S7 on the remaining candidate detection times in the detection period up to the latest candidate detection time. As a result, data on variations equal to or greater than the specified value in the detection period is accumulated in the RAM 1*b*.

In the present embodiment, the specified value is set to 30 V. In the example of FIG. 7, the approximate value at the end of the preceding approximation period is −207.23 V, as expressed by the following equation (1), and the approximate value at the beginning of the subsequent approximation period is −152.9 V, as expressed by the following equation (2). Accordingly, in the period from the cumulative print number of 12,000 to the cumulative print number of 13,000, in which the actual replacement of the photoconductor 40 has taken place, the variation is 54.33 V greater than the specified value of 30 V, as expressed by the following equation (3).

$$y=-1.27\times 9-195.8=-207.23 \quad (1)$$

$$y=-1.42\times 0-152.9=-152.9 \quad (2)$$

$$\text{variation}=-152.9-(-207.23)=54.33 \quad (3)$$

Figure 8:
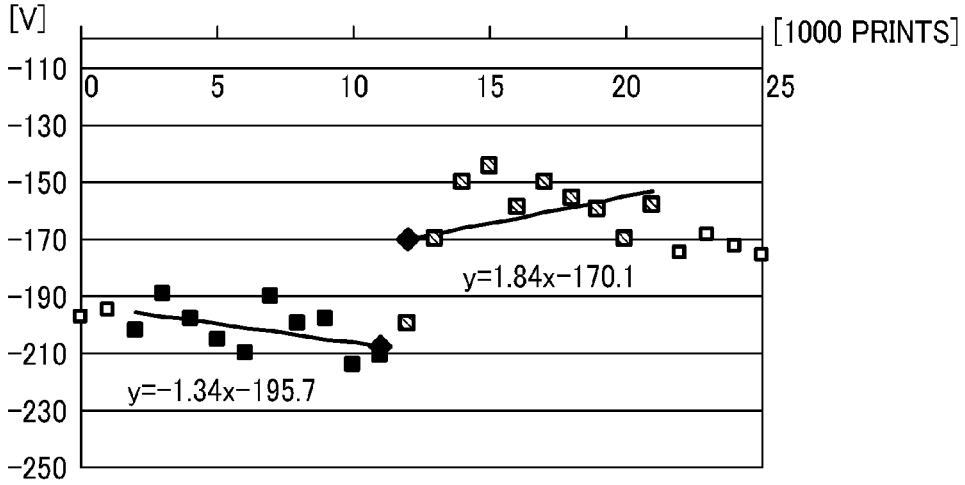
FIG. 8 is a graph illustrating approximate equations in a case in which a candidate detection time is set immediately before an actual photoconductor replacement time.

FIG. 8 is a graph illustrating approximate equations in a case in which the candidate detection time is set in a period immediately preceding the actual photoconductor replacement time, i.e., between a cumulative print number of 11,000 and a cumulative print number of 12,000. In this case, a first approximate equation for an approximation period from a cumulative print number of 2,000 to a cumulative print number of 11,000 is expressed as $y=-1.34\times-195.7$, and a second approximate equation for an approximation period from a cumulative print number of 12,000 to a cumulative print number of 21,000 is expressed as $y=-1.84\times-170.1$. The variation at this candidate detection time is 37.64. Therefore, the magnitude of the variation at this candidate detection time is also greater than the specified value of 30 V.

Figure 9:
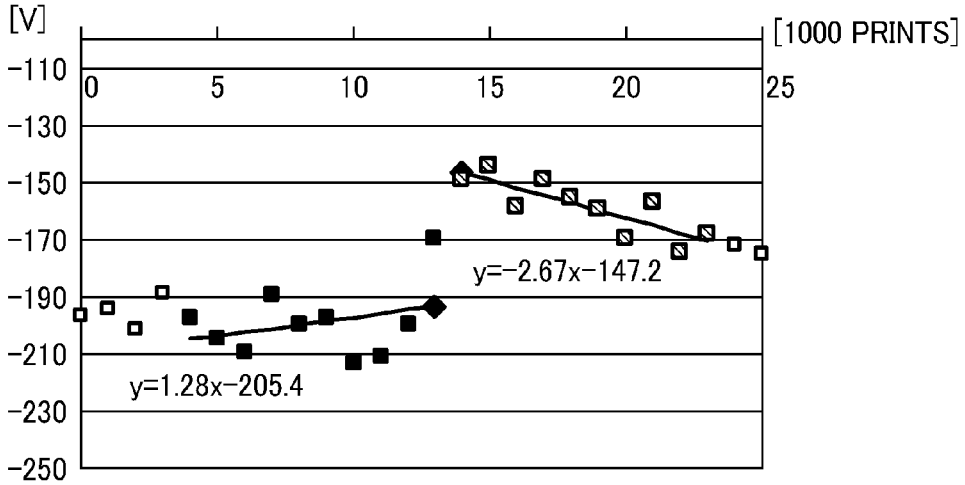
FIG. 9 is a graph illustrating approximate equations in a case in which the candidate detection time is set immediately after the actual photoconductor replacement time.

FIG. 9 is a graph illustrating approximate equations in a case in which the candidate detection time is set in a period immediately subsequent to the actual photoconductor replacement time, i.e., between a cumulative print number of 13,000 and a cumulative print number of 14,000. In this case, a first approximate equation for an approximation period from a cumulative print number of 4,000 to a cumulative print number of 13,000 is expressed as $y=-1.28\times-205.4$, and a second approximate equation for an approximation period from a cumulative print number of 14,000 to a cumulative print number of 23,000 is expressed as $y=-2.67\times-147.2$. The variation at this candidate detection time is 46.62. Therefore, the magnitude of the variation at this candidate detection time is also greater than the specified value of 30 V.

Figure 10:
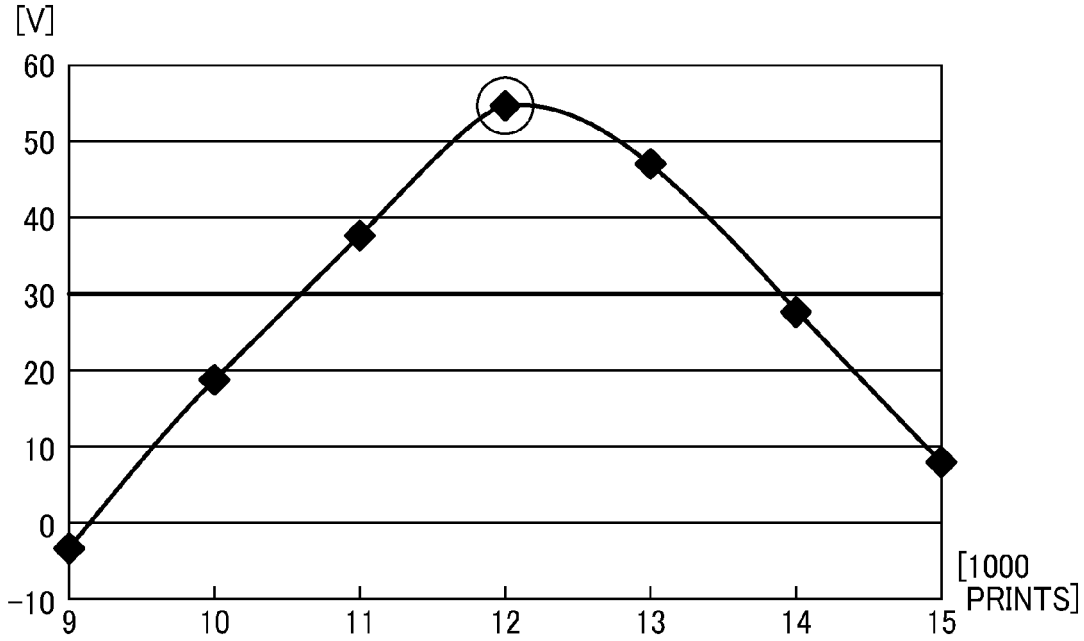
FIG. 10 is a graph illustrating changes over time of variation in photoconductor residual potential.

FIG. 10 is a graph illustrating changes over time of the variation of the photoconductor residual potential. In the present embodiment, each approximate equation is calculated with the photoconductor residual potentials at multiple points. At a candidate detection time near the actual photoconductor replacement time, therefore, the magnitude of the variation may be equal to or greater than the specified value, as illustrated in FIGS. 8 and 9. Herein, the photoconductor residual potential changes most at the time corresponding to the greatest one of the variations equal to or greater than the specified value of 30 V, and the possibility of photoconductor replacement is the highest at the time. In the present embodiment, therefore, the controller 1 identifies the greatest one of the variations equal to or greater than the specified value of 30 V (step S10), and detects the candidate detection time corresponding to the greatest variation as the photoconductor replacement time (step S11).

In the present embodiment, an example of ten-point approximation has been described for the sake of simplification of description. Alternatively, the approximation may be performed at a larger number of points, such as 64 points, for example. Further, if the frequency of detection of the photoconductor residual potential is increased, the photoconductor replacement time to be detected is reduced to a narrower range.

It is to be noted that, although the specified value for detecting the photoconductor replacement time is set to 30 V in the present embodiment, the change over time of the photoconductor residual potential varies depending on the photoconductor type. It is therefore preferable to appropriately set the specified value for each photoconductor type.

Figure 11:
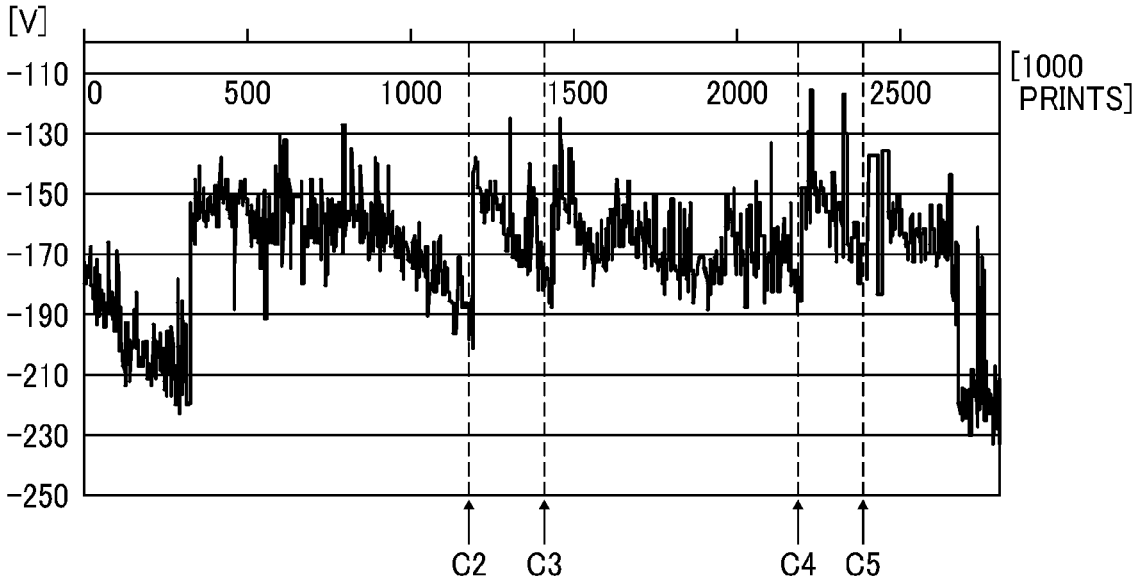
FIG. 11 is a graph illustrating detection data on the photoconductor residual potential over a relatively long period of time in which the photoconductor replacement is performed multiple times.

FIG. 11 is a graph illustrating detection data on the photoconductor residual potential over a relatively long period of time in which the photoconductor replacement is performed multiple times. In FIG. 11, at photoconductor count reset times C2 to C5 indicated by broken lines, the photoconductor count representing the cumulative usage of the photoconductor 40 (e.g., cumulative print number) is reset (i.e., cleared).

Macroscopically, the photoconductor residual potential is reduced in accordance with the usage of the photoconductor 40, and returns to a relatively high value upon replacement with a new photoconductor 40, as described above. Meanwhile, microscopically, the photoconductor residual potential is gradually reduced during continuous printing of multiple prints, and thereafter returns to a relatively high value after a certain length of time in which the photoconductor 40 is placed at rest. For example, if the photoconductor 40 is left at rest overnight after continuous printing of multiple prints, the photoconductor residual potential returns to a relatively high value next morning. If the photoconductor 4 is degraded, however, the photoconductor residual potential tends to be reduced immediately after the start of continuous printing.

As described above, the photoconductor residual potential also fluctuates during a daily printing operation. As illustrated in FIG. 11, therefore, the photoconductor residual potential substantially fluctuates in the degradation process of one photoconductor 40. To correctly observe the changes over time of the photoconductor residual potential before and after the photoconductor replacement, therefore, it is desired to reduce the influence of such fluctuations in photoconductor residual potential occurring during the daily printing operation. As described above, the present embodiment performs first-order approximation on such detection data on the photoconductor residual potential, and observes the changes over time of the photoconductor residual potential before and after the photoconductor replacement by using the resultant approximate values. With this approximation, the influence of the fluctuations in photoconductor residual potential during the daily printing operation is reduced.

Figure 12:
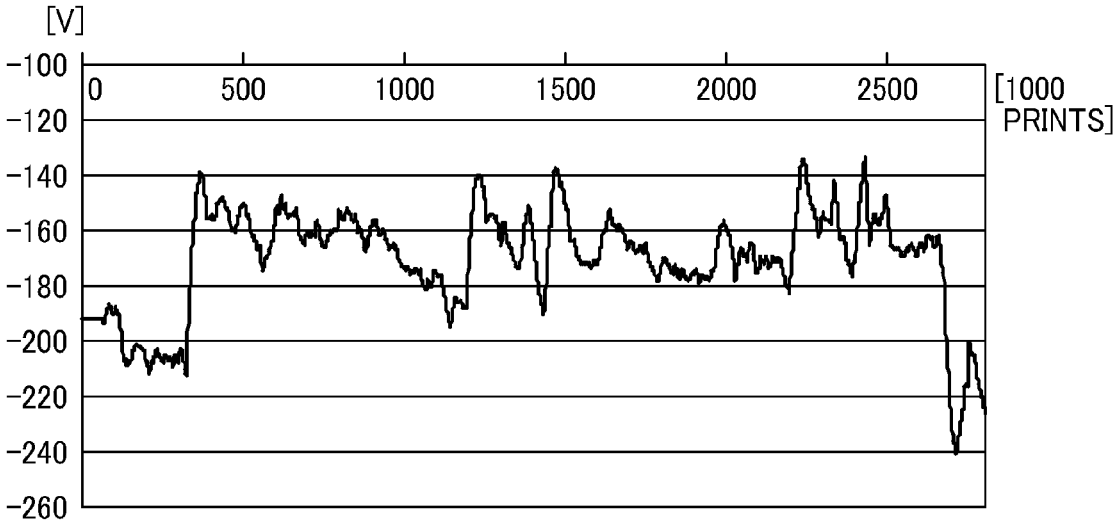
FIG. 12 is a graph plotting approximate values at respective ends of approximation periods for first-order approximation.
Figure 13:
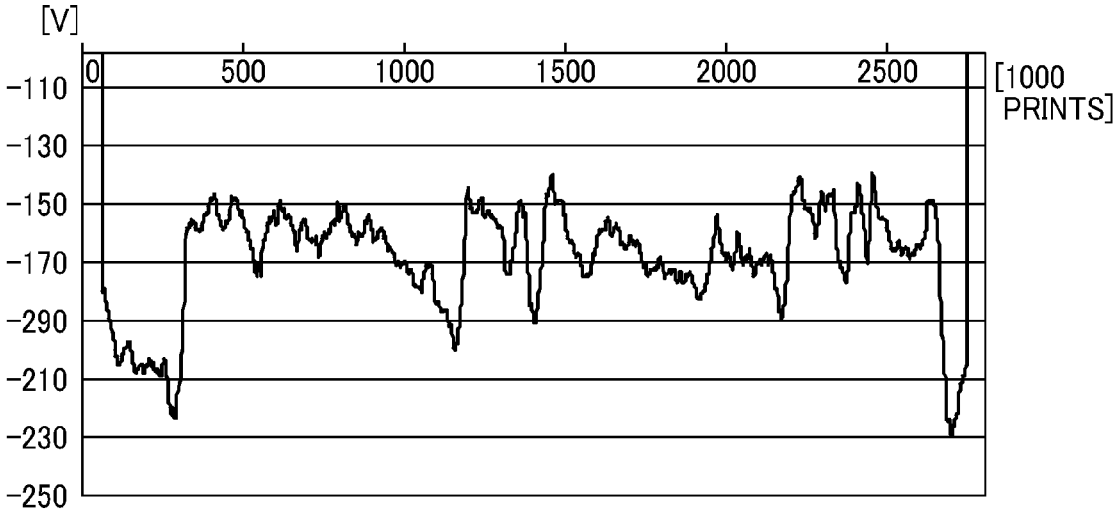
FIG. 13 is a graph plotting approximate values at respective beginnings of the approximation periods for first-order approximation.

FIG. 12 is a graph plotting approximate values at respective ends of approximation periods for the first-order approximation. FIG. 13 is a graph plotting approximate values at respective beginnings of approximation periods for the first-order approximation. Herein, each approximation period is set to perform the first-order approximation according to the least squares method with the data on photoconductor residual potentials at 64 points. Therefore, FIG. 12 illustrates changes over time of a posterior approximate value obtained by substituting the photoconductor residual potential at the last one of the 64 points in the approximate equation calculated by the least squares method using the photoconductor residual potentials at the 64 points. Similarly, FIG. 13 illustrates changes over time of an anterior approximate value obtained by substituting the photoconductor residual potential at the first one of the 64 points in the approximation equation calculated by the least squares method using the photoconductor residual potentials at the 64 points.

Figure 14:
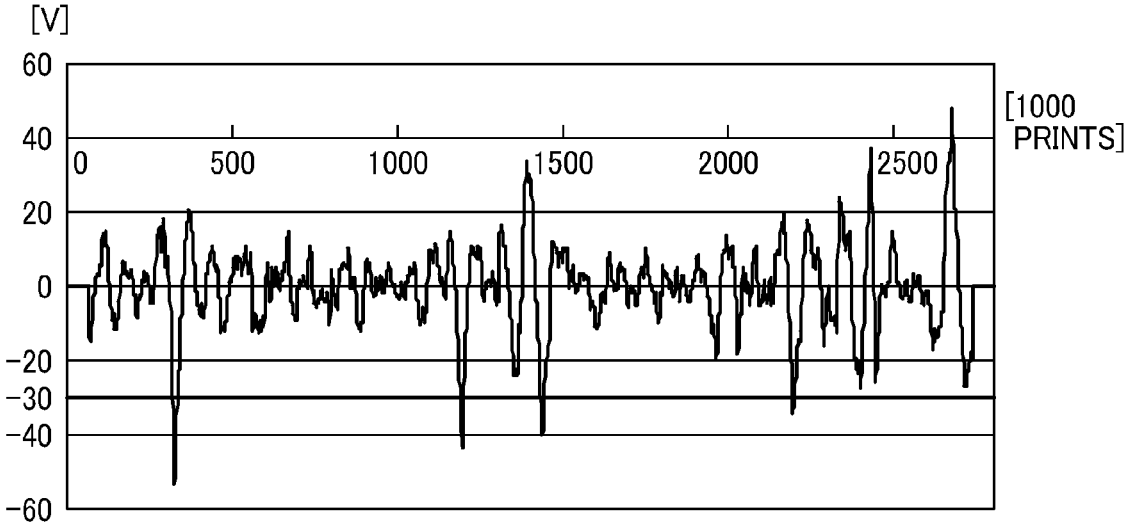
FIG. 14 is a graph plotting the difference between a posterior approximate value and an anterior approximate value of each of adjacent periods.

FIG. 14 is a graph plotting the difference between the posterior approximate value and the anterior approximate value of each of adjacent periods. In the present embodiment, if the magnitude of the difference is equal to or greater than the above-described specified value of 30 V, the time corresponding to the difference is detected as the time of replacement of the photoconductor 40. The present embodiment uses the negatively charged photoconductor 40, and thus the photoconductor residual potential is increased upon replacement of the photoconductor 40. Further, FIG. 14 plots the difference resulting from subtracting the anterior approximate value from the posterior approximate value. In the present embodiment, therefore, the time at which the difference is equal or less than −30 V is detected as the time of replacement of the photoconductor 40.

Figure 15:
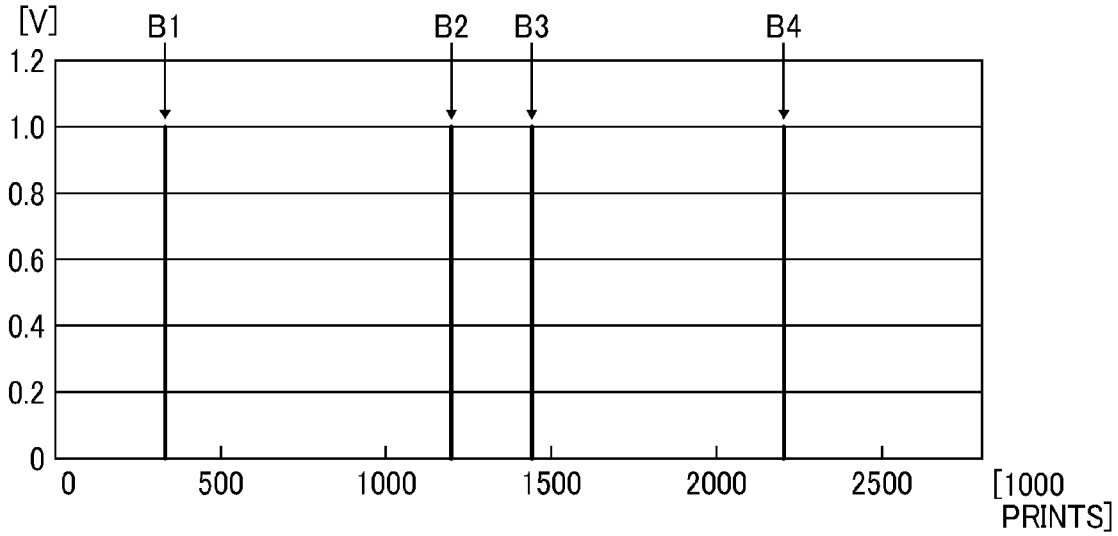
FIG. 15 is a graph illustrating the data on the difference in FIG. 14 binarized on the basis of whether or not the difference is equal to or less than −30 V.

FIG. 15 is a graph illustrating the data on the difference in FIG. 14 binarized on the basis of whether or not the difference is equal to or less than −30 V. In the present embodiment, times B1 to B4 at which the difference is determined as equal to or less than −30 V are detected as photoconductor replacement times.

Figure 16:
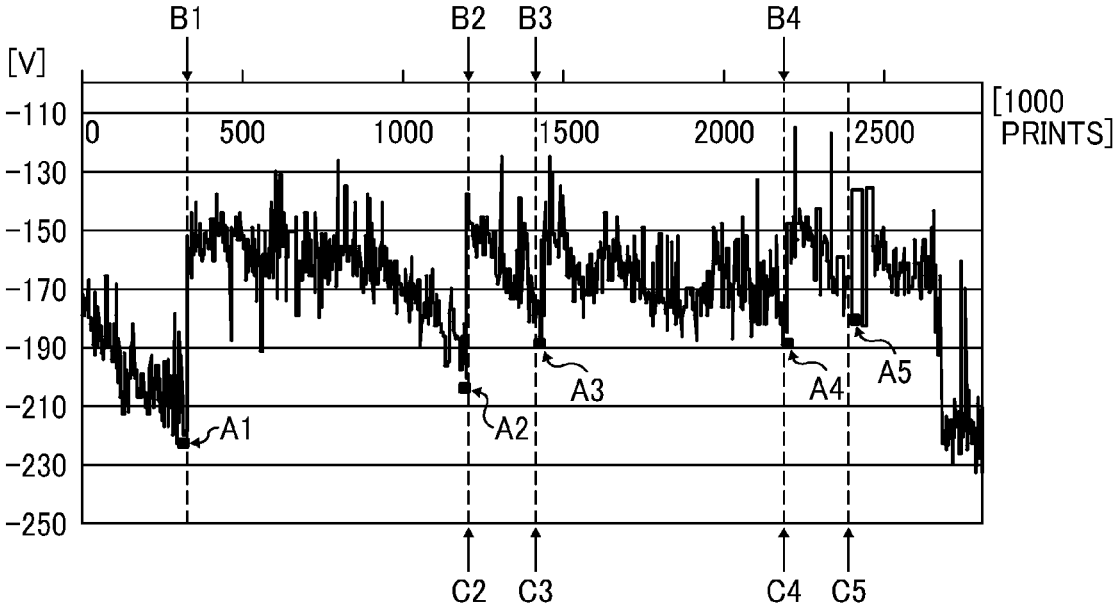
FIG. 16 is a graph illustrating the detection data on the photoconductor residual potential over a relatively long period of time in which the photoconductor replacement is performed multiple times, actual photoconductor replacement times, photoconductor replacement times detected by the present embodiment, and photoconductor count reset times.

FIG. 16 is a graph illustrating the detection data on the photoconductor residual potential over a relatively long period of time in which photoconductor replacement is performed multiple times, actual photoconductor replacement times A1 to A5, the photoconductor replacement times B1 to B4 detected by the present embodiment, and the photoconductor count reset times C2 to C5. Among the photoconductor replacement times B1 to B4 detected by the present embodiment, the photoconductor replacement times B2 to B4 match the photoconductor count reset times C2 to C4 of the photoconductor count manually reset in photoconductor replacement work. The thus-matching photoconductor replacement times B2 to B4 detected by the present embodiment and the photoconductor count reset times C2 to C4 match the actual photoconductor replacement times A2 to A4 with relatively high accuracy.

At the photoconductor replacement time B1 detected by the present embodiment, the photoconductor count is not reset, and there is no reset history of the photoconductor count. It is, however, unlikely that a sharp change in photoconductor residual potential equal to or greater than the above-described specified value (i.e., a sharp increase in photoconductor residual potential) occurs when the photoconductor 40 is not replaced. In the present embodiment, therefore, the detection result based on the changes over time of the photoconductor residual potential is given priority over the reset history of the photoconductor count, and it is determined that the photoconductor 40 has been replaced at the photoconductor replacement time B1 on the assumption that the photoconductor count has failed to be manually reset.

The photoconductor replacement time B1 matches the actual photoconductor replacement time A1. According to the present embodiment, therefore, even if the photoconductor count is not reset manually, the replacement time of the photoconductor 40 is detected, and failures to detect the photoconductor replacement time due to human error are reduced.

Meanwhile, at the photoconductor count reset time C5, actual replacement of the photoconductor 40 takes place, but the photoconductor replacement time is not detected in the present embodiment. In this case, the reset history of the photoconductor count is stored, and thus it is determined that the photoconductor 40 has been replaced at the photoconductor count reset time C5 based on the reset history. As well as the detection result of the photoconductor replacement time based on the changes over time of the photoconductor residual potential, other information such as the reset history of the photoconductor count is thus used to detect the photoconductor replacement time. Accordingly, the failures to detect the photoconductor replacement time are further reduced.

Figure 17:
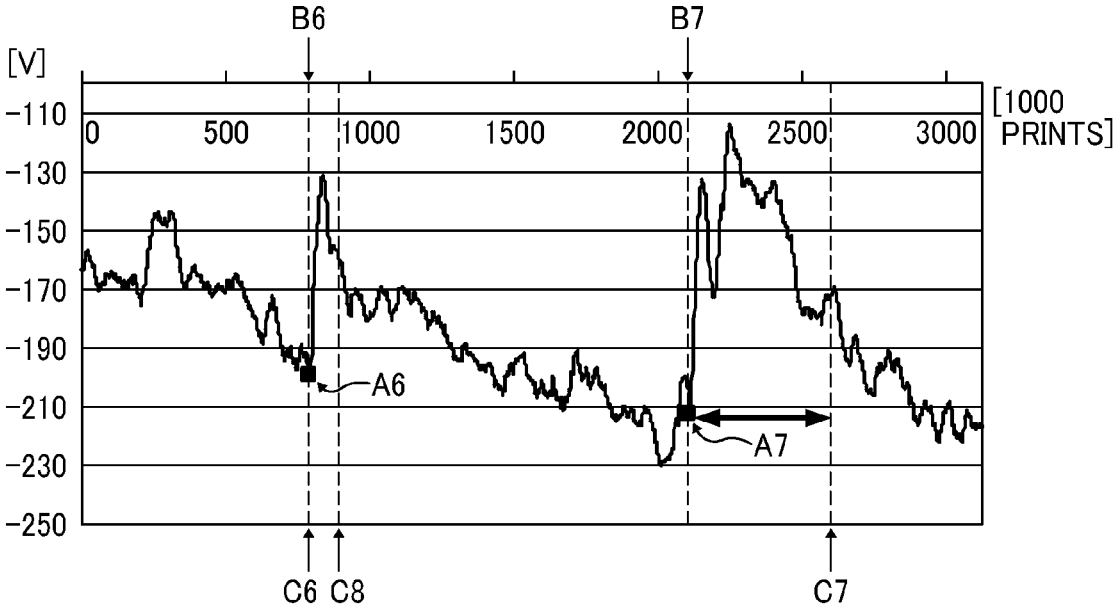
FIG. 17 is a graph of the result of another example, illustrating approximate values of the photoconductor residual potential obtained by the least squares method over a relatively long period of time in which the photoconductor replacement is performed multiple times.

FIG. 17 is a graph of the result of another example, illustrating approximate values of the photoconductor residual potential obtained by the least squares method over a relatively long period of time in which the photoconductor replacement is performed multiple times. The graph is a time-series graph of approximate values obtained by approximation at 64 points according to the least squares method. Out of photoconductor replacement times B6 and B7 detected by the present embodiment, the photoconductor replacement time B6 matches a photoconductor count reset time C6 of the photoconductor count manually reset in photoconductor replacement work. The thus-matching photoconductor replacement time B6 detected by the present embodiment and the photoconductor count reset time C6 match an actual photoconductor replacement time A6 with relatively high accuracy. At the photoconductor replacement time B7 detected by the present embodiment, the photoconductor count is not reset, and thus there is no reset history of the photoconductor count. In this case, the present embodiment gives priority to the detection result based on the changes over time of the photoconductor residual potential over the reset history, and thus determines that the photoconductor 40 has been replaced at the photoconductor replacement time B7.

Meanwhile, at a photoconductor count reset time C7 500, 000 prints after the photoconductor replacement time B7, there is a reset history of the photoconductor count, but the photoconductor replacement time is not detected by the present embodiment. However, no improvement in photoconductor residual potential is observed after the photoconductor count reset time C7. It is therefore assumed that actual replacement of the photoconductor 40 has taken place at the photoconductor replacement time B7 but the photoconductor count has failed to be reset at the time of replacement of the photoconductor 40 for some reason, and that the photoconductor count has been reset after making approximately 500, 000 prints.

Therefore, if a significant change in the variation of the photoconductor residual potential is not observed before and after a photoconductor count reset time for which the corresponding reset history of the photoconductor count exists, e.g., if the magnitude of the variation is less than 30 V, the present embodiment determines that the photoconductor 41 has not been replaced. Accordingly, erroneous detections of the photoconductor replacement time due to human error are reduced.

Further, at a photoconductor count reset time C8 100,000 prints after the photoconductor replacement time B6, there is a reset history of the photoconductor count, but the photoconductor replacement time is not detected by the present embodiment. Also in this case, a significant change in the variation of the photoconductor residual potential is not observed before and after the photoconductor count reset time C8. Thus, the present embodiment does not determine the photoconductor count reset time C8 as the photoconductor replacement time.

Further, even if a significant change in the variation of the photoconductor residual potential is observed before and after the photoconductor count reset time C8, it is unlikely that replacement of the photoconductor 40 due to, for example, the degradation thereof takes place in a relatively short period of time from the immediately preceding photoconductor replacement time A6 to the photoconductor count reset time C8 100,000 prints after the photoconductor replacement time A6. Therefore, if it is intended to limit the detection of the photoconductor replacement time to the photoconductor replacement time due to the degradation of the photoconductor 40, for example, the embodiment may be configured not to detect the photoconductor replacement time for a predetermined period of time after the last detection of the photoconductor replacement time.

The above-described embodiments and effects thereof are illustrative only and do not limit the present invention. Thus, numerous additional modifications and variations are possible in light of the above teachings. For example, elements or features of different illustrative and embodiments herein may be combined with or substituted for each other within the scope of this disclosure and the appended claims. Further, features of components of the embodiments, such as number, position, and shape, are not limited to those of the disclosed embodiments and thus may be set as preferred. It is therefore to be understood that, within the scope of the appended claims, the disclosure of the present invention may be practiced otherwise than as specifically described herein.

What is claimed is:

1. An image forming system comprising:

an image forming apparatus including a replaceable latent image carrier, and configured to form a latent image on a surface of the latent image carrier, develop the latent image into a visible image, and transfer the visible image onto a recording medium;

a physical property detector configured to detect predetermined physical properties of the image forming apparatus in one of a continuous manner and an intermittent manner;

a data storage device configured to store, as a specific physical property, data on at least one of the physical properties detected by the physical property detector, which changes before and after replacement of the latent image carrier; and a latent image carrier replacement time detector configured to detect, on the basis of changes over time of the specific physical property stored in the data storage device, a latent image carrier replacement time, wherein the latent image carrier replacement time detector is further configured to calculate an approximate equation which approximates values of the specific physical property detected in an approximation period to a functional equation, and is configured to detect the latent image carrier replacement time on the basis of an approximate value obtained from the approximate equation, wherein the latent image carrier replacement time detector is further configured to calculate, on the basis of successive first and second approximation periods, a difference between an approximate value corresponding to an end of the first approximation period obtained by the approximate equation approximating values of the specific physical property detected in the first approximation period and an approximate value corresponding to a beginning of the second approximation period obtained by the approximate equation approximating values of the specific physical property detected in the second approximation period, and wherein, when the difference is at least a specified value, the latent image carrier replacement time detector is configured to detect, as the latent image carrier replacement time, a time corresponding to a boundary between the first and second approximation periods.

2. The image forming system according to claim 1, wherein the image forming apparatus further comprises:

a charging device configured to uniformly charge the surface of the latent image carrier to a predetermined charge potential; and a discharging device configured to discharge the surface of the latent image carrier after the transfer of the visible image developed from the latent image formed on the surface of the latent image carrier uniformly charged and exposed to light, wherein the specific physical property includes a potential of the surface of the latent image carrier discharged by the discharging device.

3. The image forming system according to claim 1, wherein the latent image carrier replacement time detector is further configured to sequentially calculate the difference while shifting the first and second approximation periods, and is configured to detects, as the latent image carrier replacement time, a time corresponding to a boundary between the first and second approximation periods, at which the difference is maximized in a predetermined period.

4. The image forming system according to claim 1, wherein the latent image carrier replacement time detector does not detect the latent image replacement time before a predetermined period of time elapses after the last detected latent image carrier replacement time.

5. An image forming system comprising:

an image forming apparatus including a replaceable latent image carrier, and configured to form a latent image on a surface of the latent image carrier, develop the latent image into a visible image, and transfer the visible image onto a recording medium;

a physical property detector configured to detect predetermined physical properties of the image forming apparatus in one of a continuous manner and an intermittent manner;

a data storage device configured to store, as a specific physical property, data on at least one of the physical properties detected by the physical property detector, which changes before and after replacement of the latent image carrier;

a latent image carrier replacement time detector configured to detect, on the basis of changes over time of the specific physical property stored in the data storage device, a latent image carrier replacement time;

a cumulative usage information storage device configured to store data on a cumulative usage of the latent image carrier;

a cumulative usage resetting device configured to reset the data on the cumulative usage stored in the cumulative usage information storage device; and a reset time storage device configured to store data on a reset time at which the cumulative usage resetting device resets the data on the cumulative usage, wherein the latent image carrier replacement time detector is configured to detect the latent image carrier replacement time by using the data on the reset time stored in the reset time storage device.

6. The image forming system according to claim 5, wherein, when the reset time corresponding to the data stored in the reset time storage device does not match the latent image carrier replacement time detected on the basis of the changes over time of the specific physical property stored in the data storage device, the latent image carrier replacement time detector does not detect the reset time as the latent image carrier replacement time.

7. A latent image carrier replacement time detection method of detecting a latent image carrier replacement time of a latent image carrier in an image forming apparatus which forms a latent image on a surface of the latent image carrier, develops the latent image into a visible image, and transfers the visible image onto a recording medium, the latent image carrier replacement time detection method comprising:

detecting predetermined physical properties of the image forming apparatus in one of a continuous manner and an intermittent manner;

storing, as a specific physical property, data on at least one of the detected physical properties, which changes before and after replacement of the latent image carrier;

detecting, on the basis of changes over time of the stored specific physical property, the latent image carrier replacement time; and calculating an approximate equation which approximates values of the specific physical property detected in an approximation period to a functional equation, wherein the detecting includes detecting the latent image carrier replacement time on the basis of an approximate value obtained from the approximate equation, wherein the calculating includes calculating, on the basis of successive first and second approximation periods, a difference between an approximate value corresponding to an end of the first approximation period obtained by the approximate equation approximating values of the specific physical property detected in the first approximation period and an approximate value corresponding to a beginning of the second approximation period obtained by the approximate equation approximating values of the specific physical property detected in the second approximation period, and wherein, when the difference is at least a specified value, the detecting includes detecting, as the latent image carrier replacement time, a time corresponding to a boundary between the first and second approximation periods.

* * * * *